US011660626B2

(12) United States Patent
Park

(10) Patent No.: US 11,660,626 B2
(45) Date of Patent: May 30, 2023

(54) RECIPROCAL PUMPS

(71) Applicant: Bell Sports, Inc., Scotts Valley, CA (US)

(72) Inventor: Stephen C. Park, San Jose, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

(21) Appl. No.: 17/492,365

(22) Filed: Oct. 1, 2021

(65) Prior Publication Data

US 2022/0105530 A1 Apr. 7, 2022

Related U.S. Application Data

(60) Provisional application No. 63/087,936, filed on Oct. 6, 2020.

(51) Int. Cl.
*B05B 11/00* (2023.01)

(52) U.S. Cl.
CPC ..... *B05B 11/306* (2013.01); *B05B 11/3023* (2013.01); *B05B 11/3074* (2013.01)

(58) Field of Classification Search
CPC ..... B05B 11/306; B05B 11/3023; B05B 11/3074; F04B 39/0027; F04B 49/08; F04B 33/00; F04B 33/005
See application file for complete search history.

(56) References Cited

U.S. PATENT DOCUMENTS 6,135,733 A * 10/2000 Wu ..... F04B 33/005 417/469
6,257,849 B1 * 7/2001 Wu ..... F04B 33/005 417/469
6,318,969 B1 * 11/2001 Wang ..... F04B 33/00 417/63
6,371,741 B1 * 4/2002 Wu ..... F04B 19/02 417/446
2001/0031211 A1 * 10/2001 Wu ..... F04B 33/005 417/469
2003/0002989 A1 * 1/2003 Wu ..... F04B 33/005 417/467
2005/0186084 A1 * 8/2005 Wang ..... F04B 49/03 417/63
2013/0101453 A1 * 4/2013 Chuang ..... F04B 33/005 417/521
2016/0114635 A1 * 4/2016 Lamgaday ..... B60C 23/123 152/450
2022/0105530 A1 * 4/2022 Park ..... B05B 11/3023

FOREIGN PATENT DOCUMENTS

GB 2550144 A * 11/2017 ..... F02M 37/0023

* cited by examiner

*Primary Examiner* — Bob Zadeh
(74) *Attorney, Agent, or Firm* — Walter M. Egbert, III; Richard J. Brown; Reed Smith LLP

(57) ABSTRACT

Disclosed are a pressure regulator for reciprocating pumps comprising an audible low pressure blow off and pumps comprising the pressure regulator. Also described is a pump comprising a larger diameter barrel with a higher volume for inflating an inflatable object at a lower pressure and a smaller diameter barrel with a lower volume for inflating an inflatable object at a higher pressure, wherein the pump is switchable to operate using either the larger diameter barrel or the smaller diameter barrel using a single lever attached to an end cap of the smaller diameter barrel.

36 Claims, 25 Drawing Sheets

RECIPROCAL PUMPS

CROSS-REFERENCE TO RELATED APPLICATIONS

The present application claims priority to U.S. Provisional Application No. 63/087,936, filed Oct. 6, 2020, the disclosure of which is incorporated herein by reference in its entirety.

FIELD OF THE DISCLOSED SUBJECT MATTER

The following description relates to using inflating devices (e.g., using a hand pump) to inflate sports balls, tires, inner tubes, etc., including devices for regulating the pressure of inflatable objects and pumps with selectable volume capabilities.

BACKGROUND OF THE DISCLOSED SUBJECT MATTER

Traditional bicycle floor pumps come with a variety of features. One of the main features of more expensive pumps is to have a pressure gauge on the pump that allows the user to see how much pressure has been applied to the air cavity/tire. Some traditional floor pumps do not have any type of gauge on of the pump. They simply rely on the user to fill up their tires approximately. Most users will either give their tire a squeeze with their fingers to see if it is soft or too hard. This can be dangerous because riding with either too much pressure or too little pressure can affect the traction of your tire during a ride. Too much pressure can lead to a blow-out causing immediate tire failure. Alternatively, users may use some type of auxiliary pressure gauge that reads pressure in the tires, but this is inconvenient because the pump must be removed from the inflatable object to check the pressure in the tires.

A consumer who does not value the importance of the correct tire pressure may be a novice or recreational rider. This type of rider typically may not know what the correct pressure for their tire is, nor do they carry an auxiliary pressure gauge to check. A recreational rider would typically purchase a floor pump without a gauge because it offers the best value proposition.

It is desirable to develop a low cost, portable pump that provides a simple way for a user to inflate objects such as sports equipment and tires to a suitable pressure for their use.

SUMMARY OF THE DISCLOSED SUBJECT MATTER

Provided is a pump comprising a pressure regulator comprising a first air passage wherein a first end of the first air passage is configured to be in fluid communication with an outlet of a pump and a second end of the first air passage forms a junction with a second air passage having a first end and a second end wherein the junction of the first air passage is disposed between the first and second ends of the second air passage; wherein the first end of the second air passage is configured to be in fluid communication with an inflatable object; wherein the second end of the second air passage comprises a piston disposed therein, wherein the piston is slidingly engaged with the interior surface of the second end of the air passage and a distal end of the piston passes through an opening in the distalmost end of second end of the second air passage and is attached an inner surface of a base of a cap having a side wall attached to at least a portion of the base and disposed overlying and slidingly engaged with at least a portion of the exterior surface of the second end of the second air passage; a coil spring disposed around the piston and inside the second end of the second air passage; an opening in the side wall of the second end of the second air passage in fluid communication with a vent to the air external to the pressure regulator; wherein the piston and attached cap are configured to move distally away from the junction as pressure inside the second end of the second air passage increases, wherein the coil spring is in a non-compressed state when the interior of the pressure regulator is not pressurized and is in a compressed state when the interior of the pressure regulator is pressurized; when the pressure inside the second air passage is at or below a defined set point, the opening is blocked by the piston, and when the pressure inside the second air passage is above a defined set point, the opening is not blocked by the piston and air from inside the second air passage is vented to the air external to the pressure regulator.

Embodiments of the pump include the following, alone or in any combination.

The pump wherein venting of air through the opening in the sidewall of the second end of the second air passage produces a sound audible to a user of the pump.

The pump comprising a vibratory element that augments the sound of air venting through the opening in the sidewall of the second end of the second air passage.

The pump wherein decompression of the spring during venting air out of the pressure regulator pushes the proximal end of the piston back toward the junction, thereby covering the opening in the sidewall and blocking venting.

The pump comprising a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

The pump wherein the cap is configured to rotate about an axis defined by the second end of the second air passage, wherein when the cap is rotated to be disposed at a first position the cap is slidable along the second end of the second air passage and the audible low pressure blow off is enabled, and when the cap is rotated to be disposed at a second position the cap is not slidable along the second end of the second air passage and the audible low pressure blow off is disabled.

The pump wherein the pressure set point of the pressure regulator is in a range from about 30 to about 100 psi.

The pump wherein the pressure set point of the pressure regulator is about 40 psi.

The pump wherein the pressure set point of the pressure regulator is about 70 psi.

The pump wherein the pressure regulator comprises a plurality of different pressure set points.

The pump wherein the pressure regulator comprises a first pressure set point of about 40 psi and a second pressure set point of about 70 psi.

The pump further comprising a larger diameter barrel for inflating an inflatable object with a higher volume at a lower pressure and a smaller diameter barrel for inflating an inflatable object with a lower volume at a higher pressure, wherein the pump is switchable to operate using either the larger diameter barrel or the smaller diameter barrel.

The pump wherein the smaller diameter barrel is configured to be telescopically disposed inside the larger diameter barrel and is switchable to be selectively attached to a plunger shaft attached to a handle so that the smaller diameter barrel operates reciprocally in the larger diameter barrel; or selectively attached to the larger diameter barrel so that the plunger shaft operates reciprocally in the smaller diameter barrel.

The pump wherein the pump comprises a lever rotatably attached to an upper end cap of the smaller diameter barrel; wherein when the lever is rotated to a first position wherein the lever is engaged with a portion of the circumference of the surface of a handle and an upper face of a flange on a plunger shaft proximate to the handle to lock the lever and the upper end cap of the smaller diameter barrel to the plunger shaft, whereby moving the plunger shaft up and down moves the smaller diameter barrel reciprocally within the larger diameter barrel and the pump is effective as a larger volume relatively lower pressure device; and wherein when the lever is rotated to a second position wherein the lever is engaged with a portion of the circumference of a surface of an upper end cap of the larger diameter barrel and a lower face of a flange on the upper end cap of the larger diameter barrel to lock the lever and the upper end cap of the smaller diameter barrel to the upper end cap of the larger diameter barrel, whereby moving the plunger shaft up and down moves a plunger at the bottom of the plunger shaft reciprocally within the smaller diameter barrel and the pump is effective as a smaller volume relatively higher pressure device.

The pump wherein venting of air through the opening in the sidewall of the second end of the second air passage produces a sound audible to a user of the pump.

The pump comprising a vibratory element that augments the sound of air venting through the opening in the sidewall of the second end of the second air passage.

The pump wherein decompression of the spring during venting air out of the pressure regulator pushes the proximal end of the piston back toward the junction, thereby covering the opening in the sidewall and blocking venting.

The pump comprising a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

The pump wherein the cap is configured to rotate about an axis defined by the second end of the second air passage, wherein when the cap is rotated to be disposed at a first position the cap is slidable along the second end of the second air passage and the audible low pressure blow off is enabled, and when the cap is rotated to be disposed at a second position the cap is not slidable along the second end of the second air passage and the audible low pressure blow off is disabled.

The pump wherein the pressure set point of the pressure regulator is in a range from about 30 to about 100 psi.

The pump wherein the larger diameter barrel has an inner diameter from 40 to 50 mm.

The pump wherein the smaller diameter barrel has an inner diameter from about 25 to about 35 mm.

Another aspect provides a pressure regulator comprising a first air passage wherein a first end of the first air passage is configured to be in fluid communication with an outlet of a pump and a second end of the first air passage forms a junction with a second air passage having a first end and a second end wherein the junction of the first air passage is disposed between the first and second ends of the second air passage; wherein the first end of the second air passage is configured to be in fluid communication with an inflatable object; wherein the second end of the second air passage comprises a piston disposed therein, wherein the piston is slidingly engaged with the interior surface of the second end of the air passage and a distal end of the piston passes through an opening in the distalmost end of second end of the second air passage and is attached an inner surface of a base of a cap having a side wall attached to at least a portion of the base and disposed overlying and slidingly engaged with at least a portion of the exterior surface of the second end of the second air passage; a coil spring disposed around the piston and inside the second end of the second air passage; an opening in the side wall of the second end of the second air passage in fluid communication with a vent to the air external to the pressure regulator; wherein the piston and attached cap are configured to move distally away from the junction as pressure inside the second end of the second air passage increases, wherein the coil spring is in a non-compressed state when the interior of the pressure regulator is not pressurized and is in a compressed state when the interior of the pressure regulator is pressurized; when the pressure inside the second air passage is at or below a defined set point, the opening is blocked by the piston, and when the pressure inside the second air passage is above a defined set point, the opening is not blocked by the piston and air from inside the second air passage is vented to the air external to the pressure regulator.

Embodiments of the pressure regulator include the following, alone or in any combination.

The pressure regulator wherein venting of air through the opening in the sidewall of the second end of the second air passage produces a sound audible to a user of the pump; optionally wherein the pump further comprises a vibratory element that augments the sound of air venting through the opening in the sidewall of the second end of the second air passage.

The pressure regulator wherein decompression of the spring during venting air out of the pressure regulator pushes the proximal end of the piston back toward the junction, thereby covering the opening in the sidewall and blocking venting.

The pressure regulator wherein the cap is configured to rotate about an axis defined by the second end of the second air passage, wherein when the cap is rotated to be disposed at a first position the cap is slidable along the second end of the second air passage and the audible low pressure blow off is enabled, and when the cap is rotated to be disposed at a second position the cap is not slidable along the second end of the second air passage and the audible low pressure blow off is disabled.

The pressure regulator comprising a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

The pressure regulator wherein the pressure set point is in a range from about 30 to about 100 psi.

The pressure regulator wherein the pressure set point is about 40 psi.

The pressure regulator wherein the pressure set point is about 70 psi.

The pressure regulator of claim 23 comprising a plurality of different pressure set points.

The pressure regulator wherein the pressure regulator comprises a first pressure set point of 40 psi and a second pressure set point of about 70 psi.

Another aspect provides a pump comprising a larger diameter barrel for inflating an inflatable object with a higher volume at a lower pressure and a smaller diameter barrel for inflating an inflatable object with a lower volume at a higher pressure, wherein the pump is switchable to operate using either the larger diameter barrel or the smaller diameter barrel; wherein the smaller diameter barrel is configured to be telescopically disposed inside the larger diameter barrel and is switchable to be selectively attached to a plunger shaft attached to a handle so that the smaller diameter barrel operates reciprocally in the larger diameter barrel; or selectively attached to the larger diameter barrel so that the plunger shaft operates reciprocally in the smaller diameter barrel.

The pump wherein the pump comprises a lever rotatably attached to an upper end cap of the smaller diameter barrel; wherein when the lever is rotated to a first position wherein the lever is engaged with a portion of the circumference of the surface of a handle and an upper face of a flange on a plunger shaft proximate to the handle to lock the lever and the upper end cap of the smaller diameter barrel to the plunger shaft, whereby moving the plunger shaft up and down moves the smaller diameter barrel reciprocally within the larger diameter barrel and the pump is effective as a larger volume relatively lower pressure device; and wherein when the lever is rotated to a second position wherein the lever is engaged with a portion of the circumference of a surface of an upper end cap of the larger diameter barrel and a lower face of a flange on the upper end cap of the larger diameter barrel to lock the lever and the upper end cap of the smaller diameter barrel to the upper end cap of the larger diameter barrel, whereby moving the plunger shaft up and down moves a plunger at the bottom of the plunger shaft reciprocally within the smaller diameter barrel and the pump is effective as a smaller volume relatively higher pressure device.

The pump wherein the larger diameter barrel has an inner diameter from about 40 to about 50 mm.

The pump wherein the smaller diameter barrel has an inner diameter from about 25 to about 35 mm.

DETAILED DESCRIPTION OF THE DISCLOSED SUBJECT MATTER

Figure 1A:
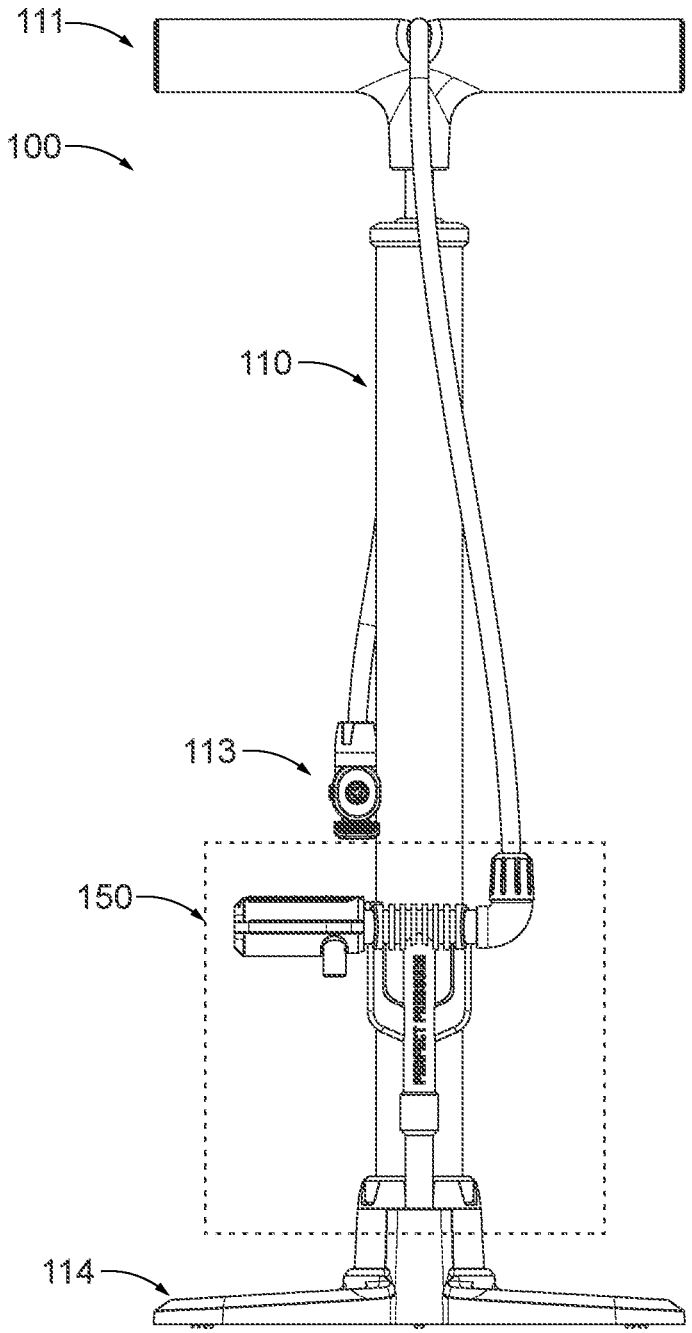
FIG. 1A is a front view of a floor pump with a pressure regulator according to an embodiment of the disclosed subject matter.

In some conventional pressure regulation devices, a flow restriction exists between the pumping device and the inlet to the inflatable object which requires pressures significantly higher than the target pressure to push the inflating fluid into the inflatable object at a satisfactory rate. This presents a significant problem for using a traditional pressure regulator or relief valve with such conventional pressure regulation devices. Simply adding a pressure relief valve or pressure regulator inline will either result in the valve opening prematurely as a result of the increased pressure required to force the inflating fluid through the inlet orifice or will require minimal airflow into the inflatable object, thus significantly prolonging the time required for inflation.

In some cases, the pressure regulation devices and techniques described here allow a user to inflate an object and, once the desired internal pressure has been reached or exceeded, the pressure regulation device will vent the internal pressure of the inflation object to the target level and alert the user. In the examples described here, a pressure regulating device is incorporated into an inflation pump for the inflation of sports balls (e.g., soccer balls, volleyballs, basketballs, footballs, etc.), air mattresses, bicycle tires, automobile tires, floating objects (e.g., rafts and other water craft, pool toys, etc.), and potentially other types of inflatable objects.

In some implementations, the pressure regulation devices and techniques described here may provide technical improvements and advantages over conventional products. For example, the pressure regulation device may, in some instances, ensure correct inflation of the inflatable object without a pressure gauge; allow a user to accurately inflate an inflatable object without knowledge of correct inflation pressure; actively regulate the pressure (e.g., by releasing air) while a user is operating the pump, thus eliminating the need for the user to pause pumping to evaluate the pressure (which may, in turn, reduce inflation time). Any combination of these and other improvements and advantages may be provided in some cases.

Most human-powered pumps used to inflate bicycle tires are reciprocating pumps. They have a piston inside an outer cylinder attached by a connecting rod to a handle for reciprocating the piston within the outer cylinder and two one-way valves: one at the outlet of the pump going to the bicycle tire and one at the inlet for outside air to enter the pump. When the pump handle is pulled out, the volume of the space defined by the piston and the outer cylinder increases and air pressure inside decreases. This draws in air from the outside through the inlet valve and closes the valve at the outlet to the bike tire. When the piston is pushed in again, it compresses the air inside. This closes the inlet valve and opens the outlet valve to the tire, pushing air into the tire.

Reciprocating pumps may take several forms. A common form is a floor pump (see FIG. 1A) in which the outer cylinder/piston assembly is oriented vertically and supported on a floor stand. The floor stand typically comprises a footpad for the user to stand on to hold the pump steady during pumping. The pump also comprises a T-handle to allow the user to grip the handle with two hands and move the piston reciprocally in the outer cylinder. Commonly, the outlet of the pump is located near the bottom of the floor pump and is configure to be in fluid communication with a hose that extends from the outlet of the pump to the inlet of the inflatable object.

A mini-pump is a small reciprocating pump configured so that a user holds the outer cylinder with one hand, usually near the outlet end of the mini-pump and moves the piston in and out of the pump with the other hand.

A frame pump is a portable pump that is designed to fit within a bicycle frame and become a part of the bike's front triangle until it is needed. It is similar in operation to the mini-pump but may have larger pumping capacity.

A foot pump comprises an outer cylinder/piston assembly disposed generally horizontally and the piston is reciprocated within the cylinder by a foot treadle rather than a handle. Typically, a foot pump may have a shorter, wider-diameter outer cylinder than a floor pump.

Audible Pressure Blow-off

Described herein is a pressure regulator that is preset by the manufacturer to stop transferring air to a tire or other inflatable object once a determined pressure, such as measured in pounds per square inch (psi) or kilopascal (kPa), is met. The pressure regulator is configured to be used together with a reciprocating pump as described above, either as a built-in integrated feature at the pump outlet, or as a modular device configured for attachment to the outlet portion of the pump.

The pressure regulator does not require the user to read any gauges. It alerts the user that they can stop pumping when they hear an audible air release from the pump during their in/out strokes. The pressure at which the pump "blows off" audibly through the pressure regulator may be set at a pressure value of from about 30 to about 100 psi (about 207 kPa to 689 kPa), including a "medium" pressure value from about 30 to about 50 psi (207 kPa to 345 kPa), such as specifically at 40 psi (276 kPa), which is generally a good pressure for the majority of the bicycles that are ridden by a novice or recreational rider who might not want to spend much on a pump or have much knowledge of what pressure their tires need. Tires on children's, mountain, beach cruiser, BMX bicycles typically require inflation to such pressures and are typically thought of as "fat" tires. Alternatively, the pressure regulator may be set at a higher pressure from about 60 to about 100 psi (about 414 to 689 kPa), such as wherein the "blow off" will be at about 70 psi (483 kPa) to provide, e.g. a higher pressure pump for inflating bicycle tires for road and hybrid bicycles. Such tires are typically thought of as "skinny" tires.

In other embodiments, the pressure blow-off may be designed for a "low" pressure below about 20 psi (128 kPa) to be used to inflate various sports balls or other inflatables. For example, volleyballs are to be inflated to a range of 4.2 to 4.6 psi (29 to 32 kPa), basketballs to a range of 7.5 to 8.5 psi (52 to 59 kPa), soccer balls to a range of 8.5 to 15.6 psi (59 to 109 kPa), and footballs to a range of 12.5 to 13.5 psi (86 to 93 kPa). Mini-pumps incorporating a pressure regulator as described herein with a blow-off set at one of these pressure settings may be useful for correctly inflating sports balls to a consistent pressure for individual use or for use in group athletic events such as practices, games and tournaments where multiple balls are used. A pump configured to have pressure regulator(s) with blow-off settings for different types of sports balls may be particularly useful for sports organizations such as schools, clubs, etc. that conduct multiple sports using different balls.

Figure 5A:
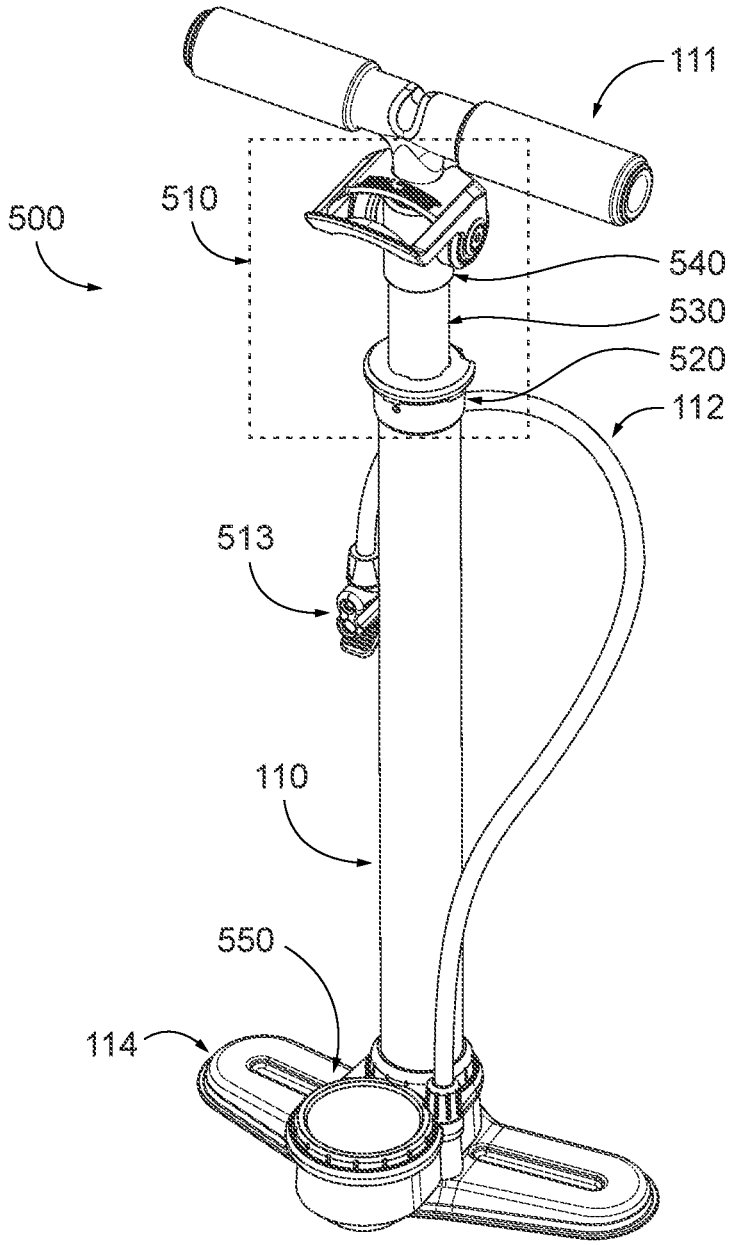
FIG. 5A shows a perspective view of a floor pump with a dual mode with a selector lever up to select a high volume mode according to an embodiment of the disclosed subject matter.

FIG. 1A shows a front exterior view of a floor pump 100 with an integrated pressure regulator 150 according to an embodiment of the disclosed subject matter. The pump 100 comprises a main outer cylinder 110, a T-shaped handle 111 attached to a piston (not shown) inside the outer cylinder 110 via a connecting rod (also not shown). Movement of the handle 111 in an up-and-down manner reciprocates the piston inside the outer cylinder 110 to move air from the external environment through the pressure regulator 150 through hose 112 and pumphead 113 into an air cavity inside an inflatable object (not shown) such as a tire. Hose 112 comprises a flexible air-tight air passage with a first (proximal) end configured to be in fluid communication with the pressure regulator 150 and a second (distal) end configured to be in fluid communication with pumphead 113. Pumphead 113 may be configured to be releasable attached to a Schrader valve commonly used on numerous tires for bicycles, motorcycles, automobiles, and other vehicles. Pumphead 113 may be attached to the Schrader valve by screwing a threaded section of pumphead 113 onto a complementary threaded section on the outside of the Schrader valve. Alternatively, pumphead 113 may comprise a lever-action quick attach/release feature that clamps pumphead 113 to the outside of the Schrader valve on the inflatable object. In some embodiments, pumphead 113 may be configured to be releasably attached to a Presta valve, often used in high pressure tires for road bikes. Pumphead 113 may be attached to a Presta valve by interchanging a Schrader-adapted head with a Presta-adapted head, or by using a Presta adapter with the Schrader-adapted pumphead. Alternatively, 513 in FIG. 5A shows a pumphead having both Schrader and Presta fittings and a quick release lever (a dual valve pumphead).

The pump 100 also comprises a stand 114 with footpad(s) for a user to stand on and stabilize the pump 100 during pumping.

Figure 1B:
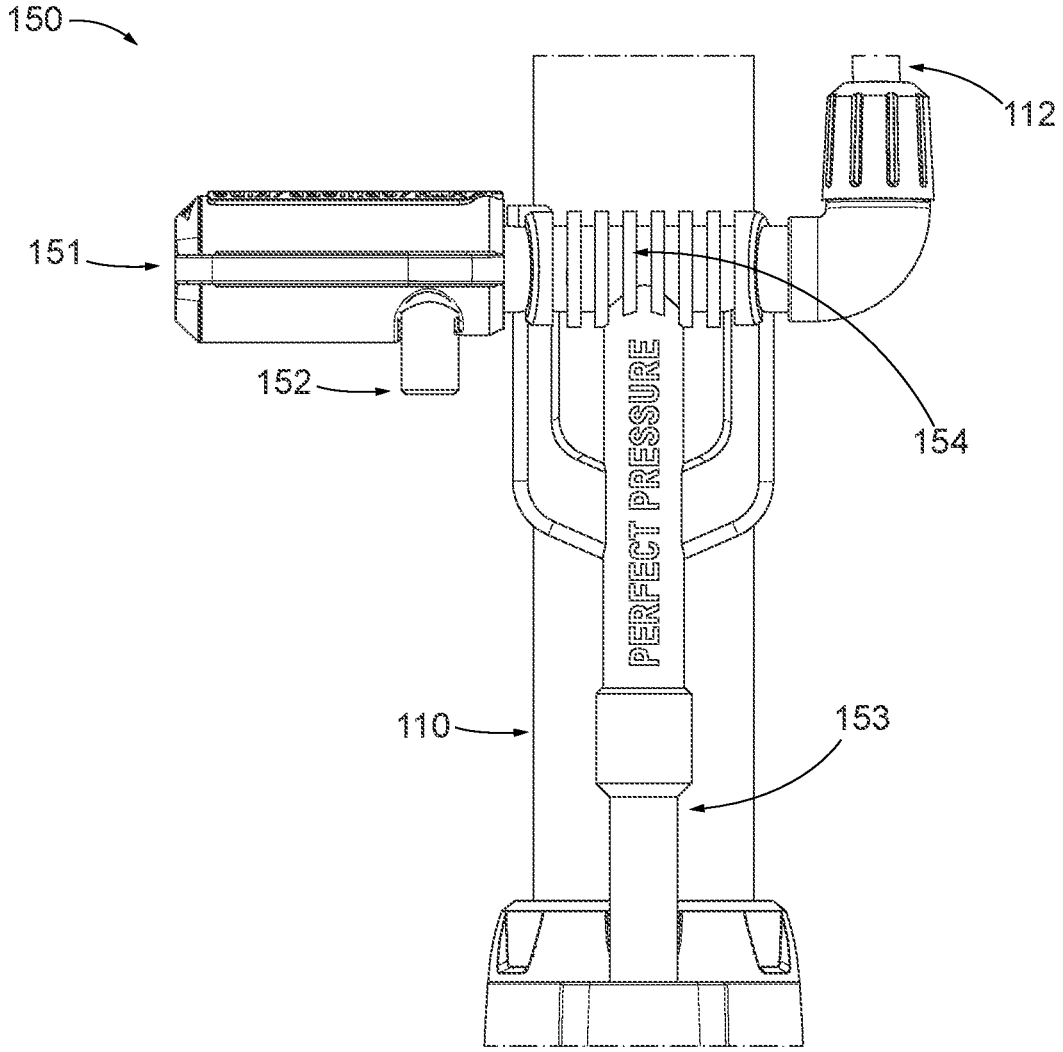
FIG. 1B is a front exterior view of a pressure regulator according to an embodiment of the disclosed subject matter.

The box with the dashed outline in FIG. 1A highlights the pressure regulator 150, shown enlarged in FIG. 1B. FIG. 1B shows a front exterior view of a pressure regulator according to an embodiment of the disclosed subject matter. The pressure regulator 150 comprises a cap 151, a blow-off outlet 152, a first air passage 153 wherein a first end of the first air passage 153 is configured to be in fluid communication with outlet 119 of pump 100 and a second end of the first air passage forms a junction with a second air passage 154 having a first end and a second end wherein the junction of the first air passage 153 is disposed between the first and second ends of the air passage 154. The first end of the air passage 154 is configured to be in fluid communication with an inflatable object via hose 112 of pump 100. The second end of air passage 154 comprises the interior of the pressure regulator 150 as shown better in FIGS. 2A and 2B.

Figure 2A:
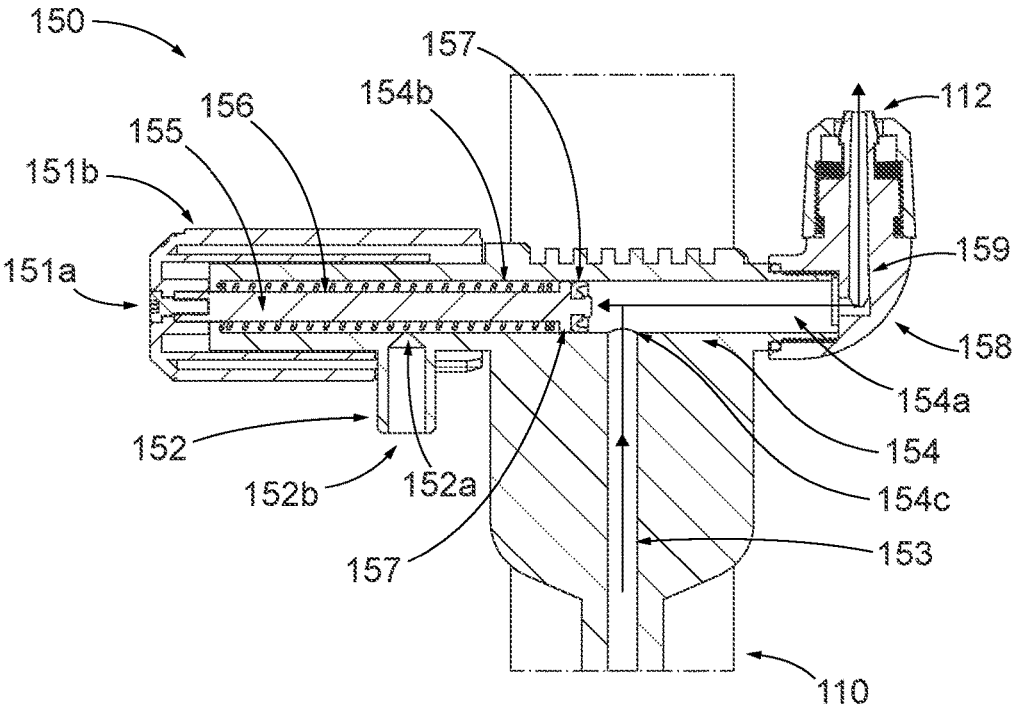
FIG. 2A is a section view of the floor pump showing the pressure regulator in a resting position according to an embodiment of the disclosed subject matter.
Figure 2B:
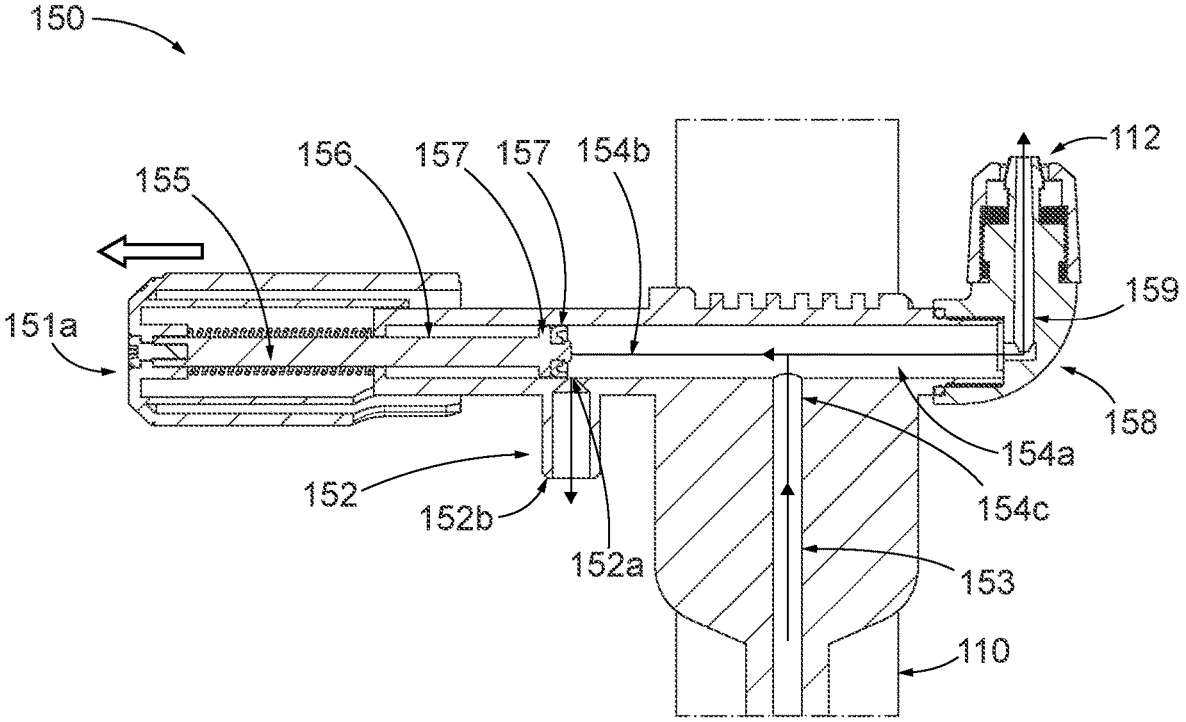
FIG. 2B is a section view of the floor pump showing the pressure regulator in a pressurized position according to an embodiment of the disclosed subject matter.

The interior of the pressure regulator 150 is shown in FIGS. 2A and 2B. FIG. 2A is a section view of the floor pump showing the pressure regulator in a resting (non-pressurized) position according to an embodiment of the disclosed subject matter. The first end of air passage 153 is in fluid communication with the outlet 119 of pump 100 (not shown). The second end of air passage 153 intersects with air passage 154 at junction 154*c*. The first end of air passage 154, i.e. 154*a*, is in fluid communication with the interior of hose 112 via air passage 159 in fitting 158. The second end of air passage 154, i.e. 154*b*, comprises the interior of the pressure regulator 150. In the resting position, no air is flowing through air passages 153 and 154. When the pump is operated as discussed further below, the direction of air flow within air passages 153 and 154 is indicated by arrows. Air can flow from the pump outlet 119 (not shown) along air passage 153 toward junction 154*c*. At junction 154*c*, air can flow toward the first end of air passage 154, 154*a*, and from there to the interior of hose 112 and further into the air cavity of an inflatable object such as a tire (not shown). Air can also flow from junction 154*c* toward the second end of air passage 154, 154*b*, and impinge on the proximal end of piston 155.

Cap 151 comprises a base 151*a* and a side wall 151*b* attached to at least a portion of the base 151*a* and disposed overlying and slidingly engaged with at least a portion of the exterior surface of air passage 154. The distal end of piston 155 is attached to the center of the inner surface of the base 151*a* and is slidingly engaged with the interior surface of the second end of the air passage 154, 154*b*. A coil spring 156 is disposed around piston 155 and inside 154*b*. Flanges at the proximal end of piston 155 and the distalmost portion of second end 154*b* hold the spring 156. In the resting position, spring 156 is in a neutral or non-compressed state. A rubber seal 157 disposed on the proximal end of the piston 155 slidingly engages the inner surface of air passage 154 and provides a substantially air-tight seal.

Blow off outlet 152 comprises a small (such as a pinhole) opening 152*a* in fluid communication with air passage 154 within the second end 154*b*. Blow off outlet 152 also comprises vent 152*b* that directs air from opening 152*a* into the environment exterior to the pressure regulator 150. In the resting position shown in FIG. 2A, the proximal end of piston 155 blocks air flow in air passage 154 form reaching blow off outlet 152.

FIG. 2B is a section view of the floor pump showing the pressure regulator in a pressurized position according to an embodiment of the disclosed subject matter. The interior of air passages 153, 154, 159, interior of hose 112 and an air cavity within an inflatable object attached to hose 112 by pumphead 113, bounded by the proximal end of piston 155 and the one way valve of outlet 119 of pump 100 define a closed volume into which air can be introduced by a user operating pump 100. As pressurized air from the pumping action of pump 100 enters the closed volume it is at a pressure above the ambient exterior pressure and can equilibrate throughout the closed volume. As pressure rises within the closed volume, it pushes against the proximal end of piston 155 and moves the piston 155 and attached cap 151 distally away from junction 154*c* as indicated by the arrow. The increased pressure also compresses spring 156 to an extent wherein the compressive force on the spring matches the air pressure within the closed volume. The force needed to compress spring 156 can be calibrated so that when it matches that of a desired air pressure, the spring is compressed to an amount that can be used to localize opening 152*a* in the barrel of air passage 154. When the pressure is at or below a defined set point, the opening 152*a* is blocked by piston 155. As pumping continues, each stroke increases the pressure within the closed volume and advances the piston further distally. When pressure exceeds the set point, the proximal end of piston 155 reaches and passes the locus of opening 152*a*, thereby providing fluid communication from air passage 154 through opening 152*a* and vent 152*b* into the exterior environment, as shown in FIG. 2B. Pressurized air passing thorough opening 152*a* results in a "hiss" audible to a user as a signal that the set pressure has been reached and pumping can be stopped. In some embodiments, a vibratory element such as a reed can augment the sound emitted by the blow off outlet 152. Venting air out of the pressure regulator 150 via vent 152*b* will continue until the pressure falls back to the desired set point. Spring 156 decompresses slightly, pushing the proximal end of the piston back toward junction 154*c*, thereby covering opening 152*a* and blocking venting. This provides a simple mechanism for regulating pressure in the closed volume, which includes the air cavity inside the inflatable object.

By way of illustration, a first "in" stroke of pump 100 pushes an amount of air from the outlet 119 into air passage 153 and pressure throughout the closed volume may be, for example, equal to 5 psi (34 kPa) and piston 155 is pushed in the direction indicated by the arrow. Continued pumping will result in incremental increases of pressure during each "in" stroke. When the pressure inside air passage 154 exceeds a defined set point (for example 40 psi (276 kPa)) by a small amount, the proximal end of piston 155 is advanced sufficiently down air passage 154*b* to expose the opening 152*a* and allow a portion of the air pumped into the air passages to escape through vent 152*b*. Venting of air continues until the pressure falls to 40 psi (276 kPa), at which point the piston 155 blocks opening 152*a* and prevents further venting.

The configuration of the pump 100 and pressure regulator 150 shown in FIGS. 1A through 2B is exemplary and illustrative and not limiting. When used in conjunction with a floor pump such as that shown in these figures, the pressure regulator 150 may be disposed at a different position relative to the pump 100. For example, air passage 153 may be elongated so that the pressure regulator 150 is disposed at the end of outer cylinder 110 proximate to the handle 111 instead of proximate to the floor stand 114. Alternatively the pressure regulator 150 may be disposed at the end of hose 112 proximate the outlet 113. The reciprocating pump may be alternatively a mini-pump, frame pump, foot pump or other type.

As discussed above, the pressure regulator 150 may be integrated into a pump at time of manufacture, or may be configured as an attachable module to convert an existing pump to a pump comprising the audible blow off feature embodied in pressure regulator 150. For example, a pressure regulator 150 may be inserted between outlet 119 and hose 112 of an existing pump. Alternatively, pressure regulator 150 may be configured to be attached to pumphead 113 of an existing pump and may comprise a pumphead similar to pumphead 113 to attach directly to the inlet of an inflatable object.

Also, pressure regulator 150 is shown in FIGS. 1A through 2B with air passages 153, 154*a* and 154*b* as approximately similar in length and configured in a T-shape, but neither aspect is limiting. The length of air passage 154*b* is generally dependent on factors such as the size and compression of coil spring 156 at the desired set point, which in turn is at least partially determinative of the position of opening 152*a* as discussed above. However, air passages 153 and 154*b* are generally open tubes so their length may be significantly shorter or longer than the length of air passage 154*b* and may be largely dependent on how the pressure regulator 150 is integrated into the pump.

In some embodiments, the orientation of the air passages may not be in the T-shape as shown. For example, air passages 153 and 154*a* may be configured to be collinear, with air passage 154*b* directed away from collinearity, such as configured to be perpendicular to 153 and 154*a*, at junction 154*c*. In other embodiments air passages 153 and 154*b* may be configured to be collinear, with air passage 154*a* directed away from collinearity, such as configured to be perpendicular to 153 and 154*b*, at junction 154*c*. In other embodiments, one or more of air passages 153, 154*a* and 154*b* may comprise one or more turns proximate to junction 154*c* to provide a more compact shape. For example, one or both of air passages 154*a* and 154*b* may comprise a turn so that air passages 154*a* and 154*b* are substantially parallel. In other examples, one or both of air passages 154*a* and 154*b* may comprise a turn so that one or both of air passages 154*a* and 154*b* are substantially parallel to air passage 153. In other examples, air passage 153 may comprise a turn so that it is substantially parallel to either 154*a* or 154*b*.

Further, air passages 153, 154*a* and 154*b* are depicted in 1A through 2B as being substantially coplanar, but this is not limiting.

Visual Indicator

Figure 3A:
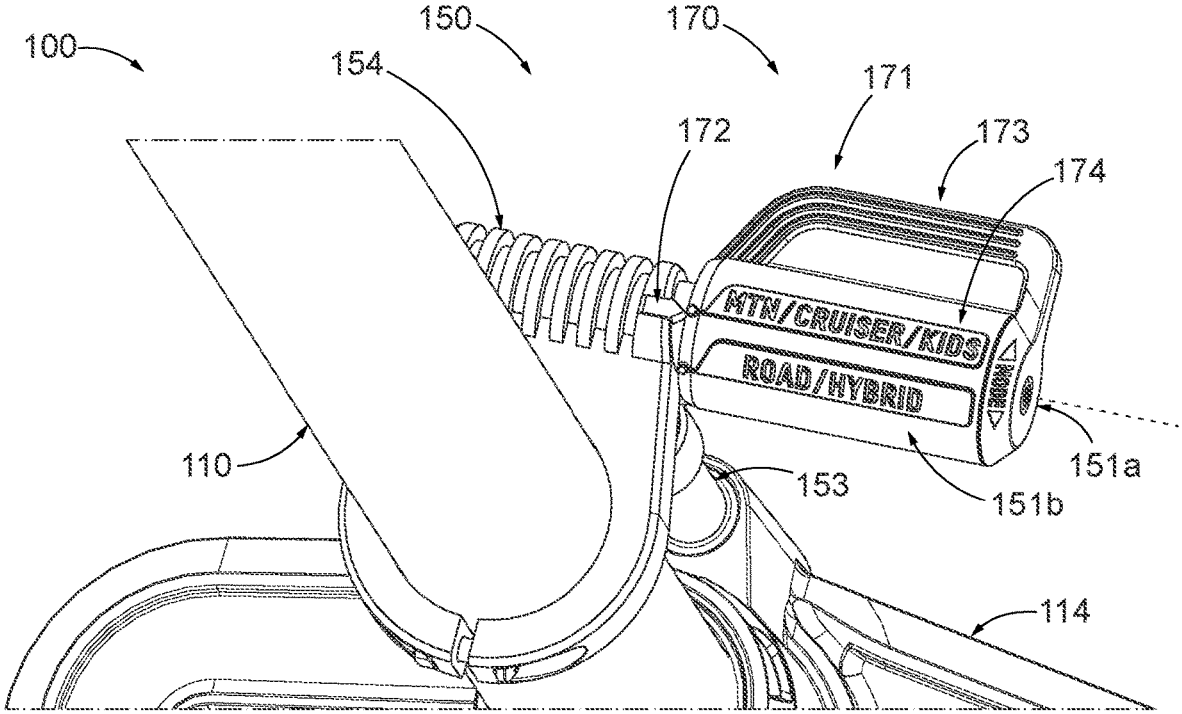
FIG. 3A is a perspective view of the top of the pressure regulator in a resting position according to an embodiment of the disclosed subject matter.
Figure 3B:
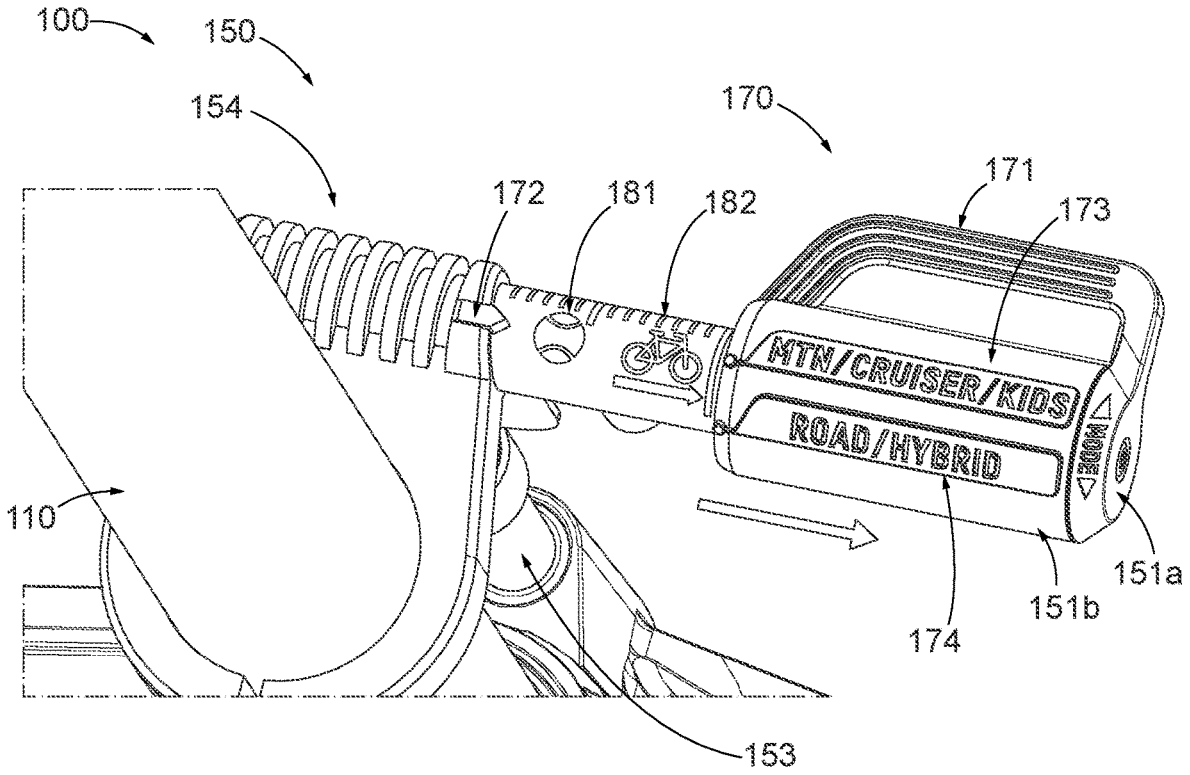
FIG. 3B is a perspective view of the top of the pressure regulator in a pressurized position according to an embodiment of the disclosed subject matter.

In addition to the audible indicator of this pump described above, the pressure regulator 150 may also include a visual indicator. This provides a secondary indicator that increases the usefulness of this pump. For example, if someone is hearing impaired this visual aspect maybe of importance. As shown in FIGS. 3A and 3B, the visual indicator in pressure regulator 150 comprises cap 151 sliding along the exterior surface of air passage 154 as the user operates pump 100 and builds up pressure inside the regulator 150. FIG. 3A is a perspective view of the top of the pressure regulator in a resting position according to an embodiment of the disclosed subject matter. The resting position shown in FIG. 3A corresponds to the resting position shown in FIG. 2A. As shown in FIG. 3A, sidewall 151*b* of cap 151 overlays substantially the entire length of air passage 154*b*. FIG. 3B is a perspective view of the top of the pressure regulator in a pressurized position according to an embodiment of the disclosed subject matter, corresponding to the pressurized position shown in FIG. 2B. Comparison of FIGS. 3A and 3B shows that cap 151 has moved in the direction indicated by the arrow as the pressure regulator 150 is pressurized. As a result, a larger portion of the exterior surface of air passage 154*b* is exposed to view (FIG. 3B). Indicia may be disposed on the exterior surface of air passage 154*b* and are also exposed to view as cap 151 moves in the direction indicated by the arrow. Indicia may be raised, recessed and/or applied (e.g. painted) on the exterior surface of air passage 154*b*. Indicia may comprise a graduated scale of marks corresponding to different pressure values, optionally numbered (not shown). Alternatively or additively, indicia may comprise alphanumeric text and/or visual representations such as icons or pictographs. For example as shown as in FIG. 3B, text and pictograph 181 indicate a low pressure region suitable for inflating various sports balls. Because this is a low pressure indicator it will be exposed first as pressure increases in the pressure regulator 150. Further pressure increases will begin to expose pictograph 182, representing inflating a bicycle tire. When the pressure inside pressure regulator 150 reaches the pressure set point (e.g. 40 psi (276 kPa)), pictograph 182 is fully exposed and the audible pressure indicator as described above will sound. The combination of audible and visual indication will alert the user that the desired pressure has been reached.

Lock-Out Mode

An optional feature of the pressure regulator 150 is that it comprises a second mode that is activated by the user in which a switch is rotated to cancel the blow off at 40 psi (276 kPa). This will allow the user to continue pumping past 40 psi (276 kPa) all the way up the maximum pressure the pump can handle without any blow-off feature. This may be used in an instance where a user wishes to inflate tires for two different types of bicycles, one for pressure below or at 40 psi (276 kPa) using the blow off feature, and canceling the blow off feature to be used on a road or hybrid bicycle that requires inflation to be more than 40 psi (276 kPa).

In an exemplary embodiment of this lock-out option the visual indicator described above also doubles as the switch to activate the lock-out mode. This embodiment is illustrated in FIGS. 3A, 3B, 4A and 4B. The lock-out feature 170 comprises cap 151 configured to be rotated about the axis defined by air passage 154*b*. In this embodiment cap 151 comprises a tab or flange 171 to facilitate its rotation. Indicator 172 on the exterior surface of air passage is used to align the rotatable cap 151 to either enable the audible blow off feature or lock out the audible blow off feature. When indicia 173 on sidewall 151*b* of cap 151 are aligned with indicator 172 (see FIG. 3A), the audible blow out feature is enabled and the cap 151 will slide along the exterior surface of air passage 154*b* as pressure increases, indicated by the arrow shown in FIG. 3B until it reaches the pressure set point and blow off through blow off outlet 152 (FIG. 1B).

The lock-out mode is activated by rotating cap 151 forward/downward (clockwise when viewed along the axis indicated by the dotted line shown in FIG. 3A) to align indicia 174 with indicator 172. Rotating the visual indicator forward/downward to lock-out mode prevents the cap 151 from sliding along the air passage 154*b* in the direction of the arrow shown in FIG. 3B. As a result, piston 155 attached to cap 151 cannot slide in the air passage 154*b* as shown in FIG. 2B and the opening 152*a* is not rendered in fluid communication with air passage 154*b* as shown in FIG. 2B. Prevention of movement of cap 151 and attached piston 155 prevents the pressure regulator 150 from blowing off through outlet 152.

Figure 4A:
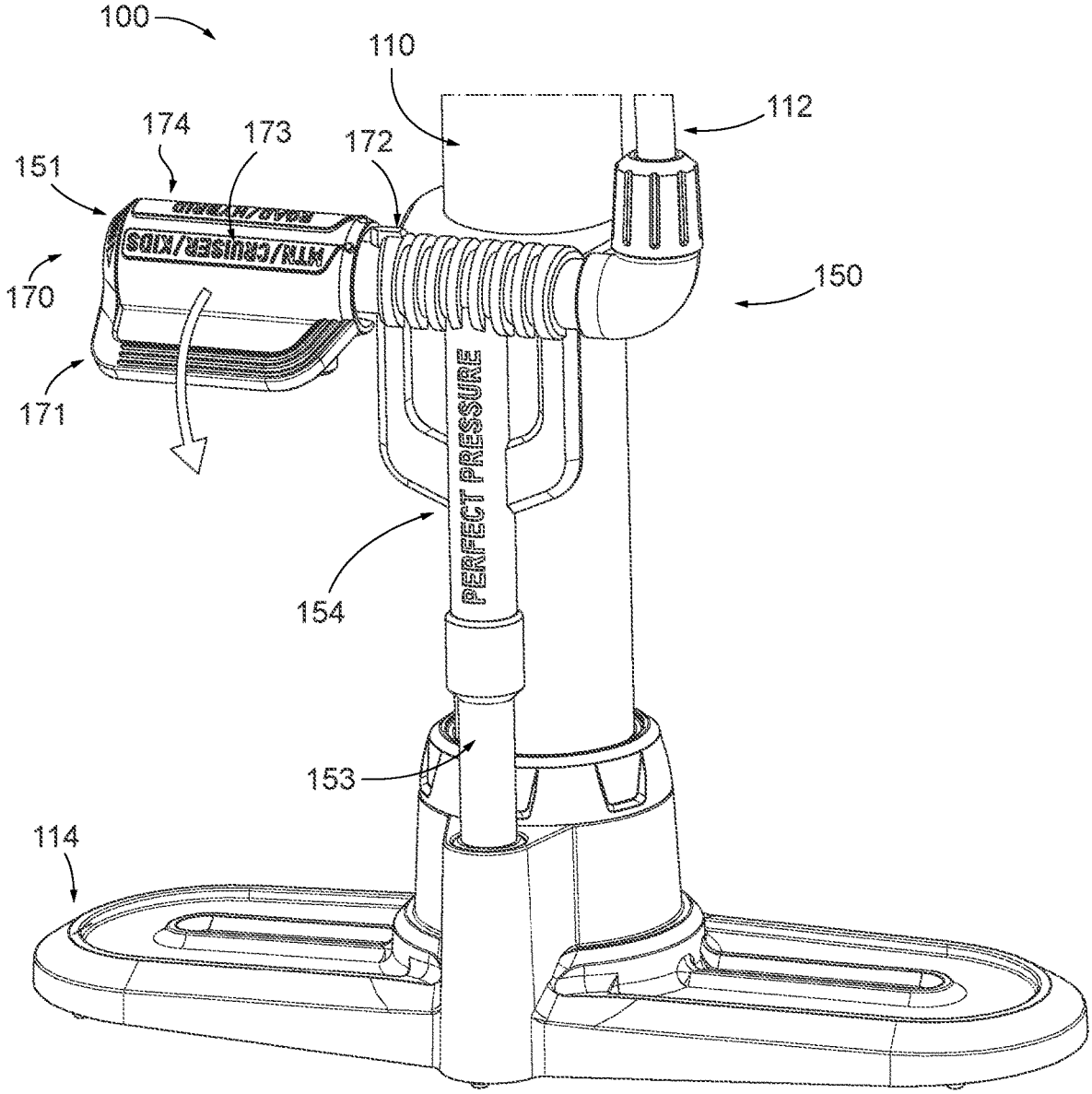
FIG. 4A is a front perspective view of the pressure regulator showing a pressure selector cap according to an embodiment of the disclosed subject matter.
Figure 4B:
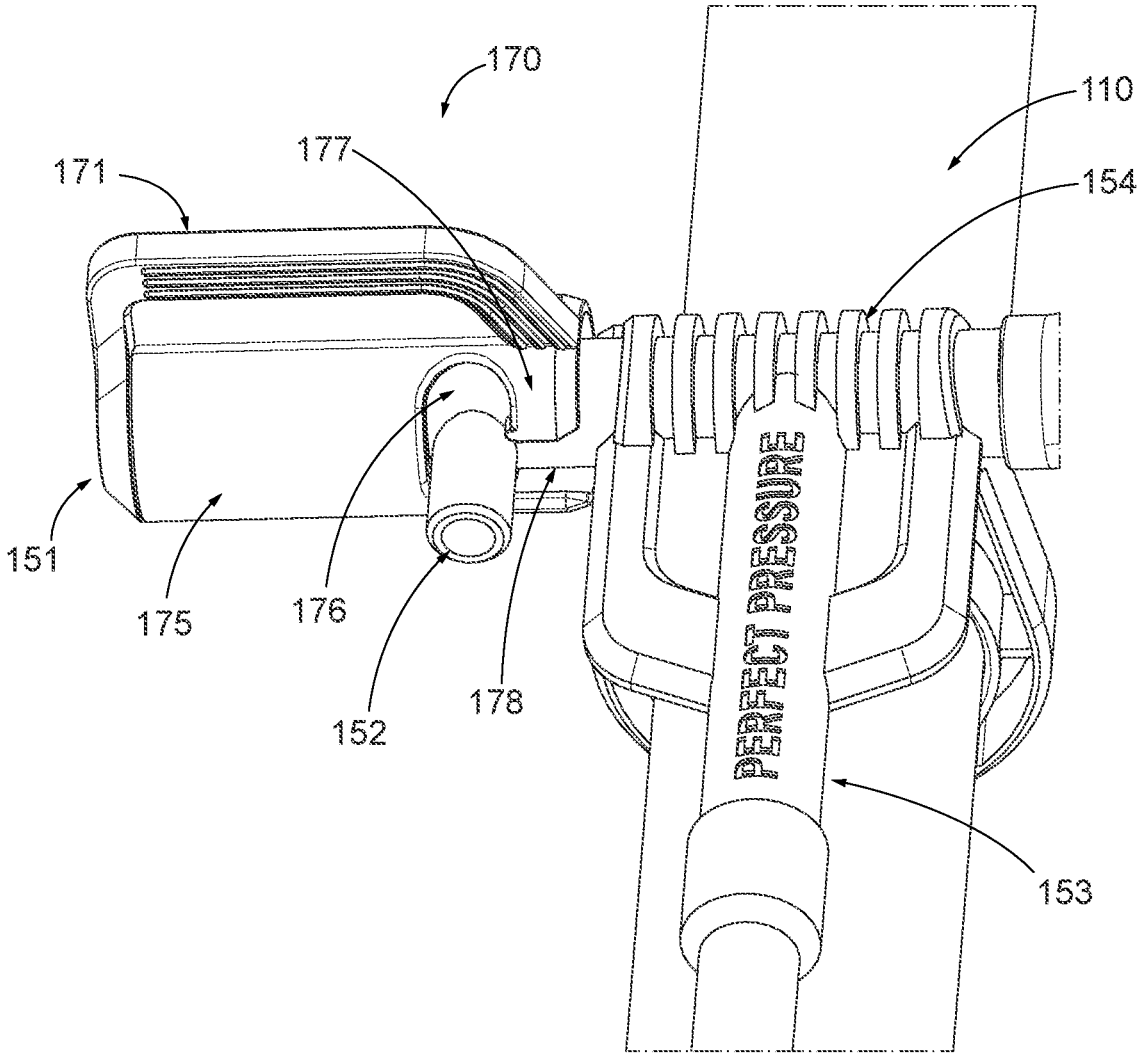
FIG. 4B is a perspective view of the pressure regulator showing the bottom of a pressure selector cap according to an embodiment of the disclosed subject matter.
Figure 4C:
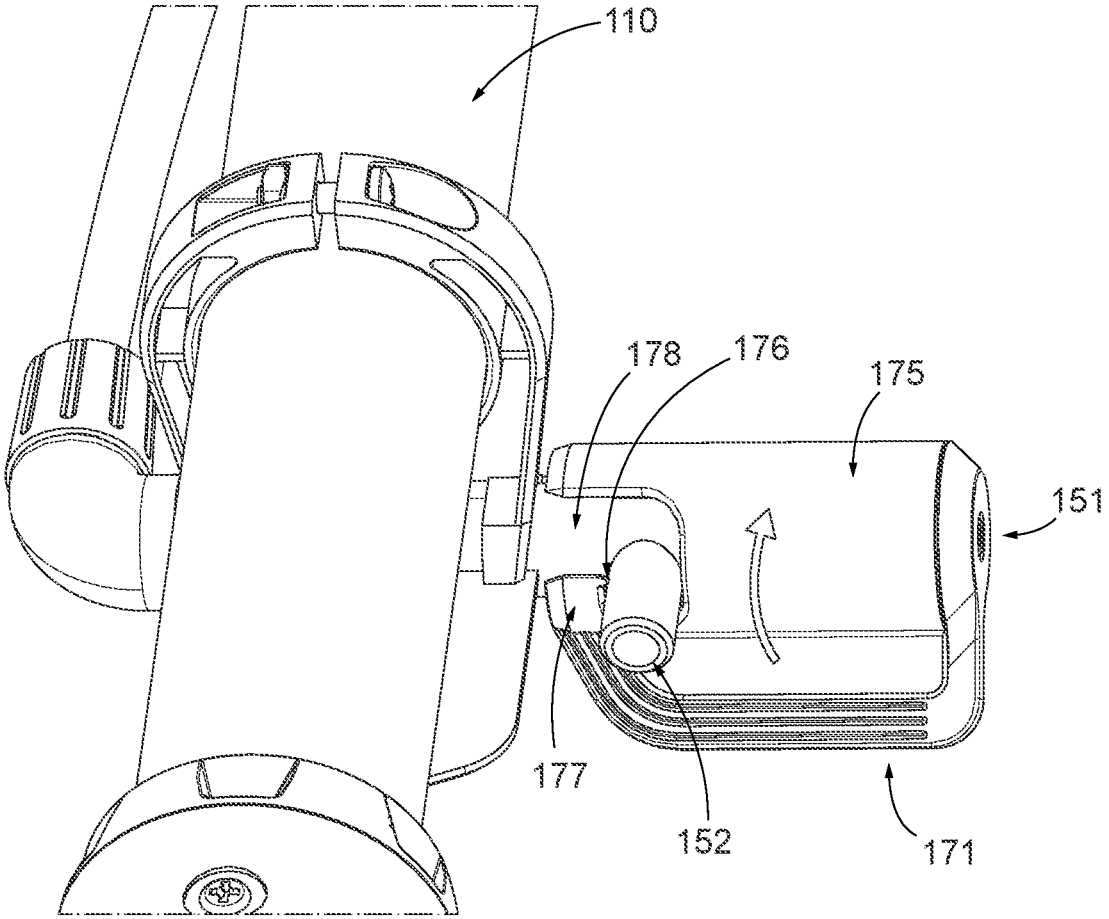
FIG. 4C is another perspective view of the pressure regulator showing the bottom of a pressure selector cap according to an embodiment of the disclosed subject matter.

FIG. 4A is a front perspective view of the pressure regulator 150 showing a pressure selector cap 151 according to an embodiment of the disclosed subject matter. FIGS. 4B and 4C show perspective views of the pressure regulator 150 showing the bottom of pressure selector cap 151 according to an embodiment of the disclosed subject matter. In FIG. 4B, the selector cap 151 is in the audible blow off configuration. FIG. 4B shows the bottom 175 of the selector cap 151. The bottom 175 comprises a cut-out 176 and tab 177. Cut-out 176 and tab 177 do not extend as far circumferentially around the exterior surface as the rest of bottom 175, providing a slot 178 that can pass by blow off outlet 152, allowing the cap 151 to slide distally along air passage 154*b*. As shown in FIG. 4C, when selector cap 151 is rotated from the position shown in FIG. 4B in the direction shown by the arrow, cut-out 176 and tab 177 are rotated to surround a portion of the circumference of blow off outlet 152 and slot 178 is not in alignment to pass by blow off outlet 152. In particular, tab 177 blocks distal movement of selector cap 151, preventing blow off. One can appreciate that in this embodiment, when the selector cap 151 is in the lock out configuration, the visual indicator described above is also disabled.

Although the preceding discussion relates generally to embodiments wherein the pressure regulator has a single blow-off setting, in some embodiments, two or a plurality of blow-off settings may be envisioned in the pressure regulator. For example, a pressure regulator as described herein may be used in conjunction with a reciprocating pump for inflating bicycle tires at two (or more) different pressures, such as a blow-off setting at 40 psi (276 kPa) for inflating medium pressure tires and a blow-off setting at 70 psi (483 kPa) for inflating high pressure tires.

In embodiments having two or more blow-off settings, a selector mechanism selectively blocks passage of air from flowing out of the pressure regulator 150 at a lower pressure setting, such as 40 psi (276 kPa). This allows air pressure to continue to rise in the pressure regulator 150, pushing piston 155 further distally until it reaches a higher pressure blow-off setting, such as 70 psi (483 kPa).

Figure 4D:
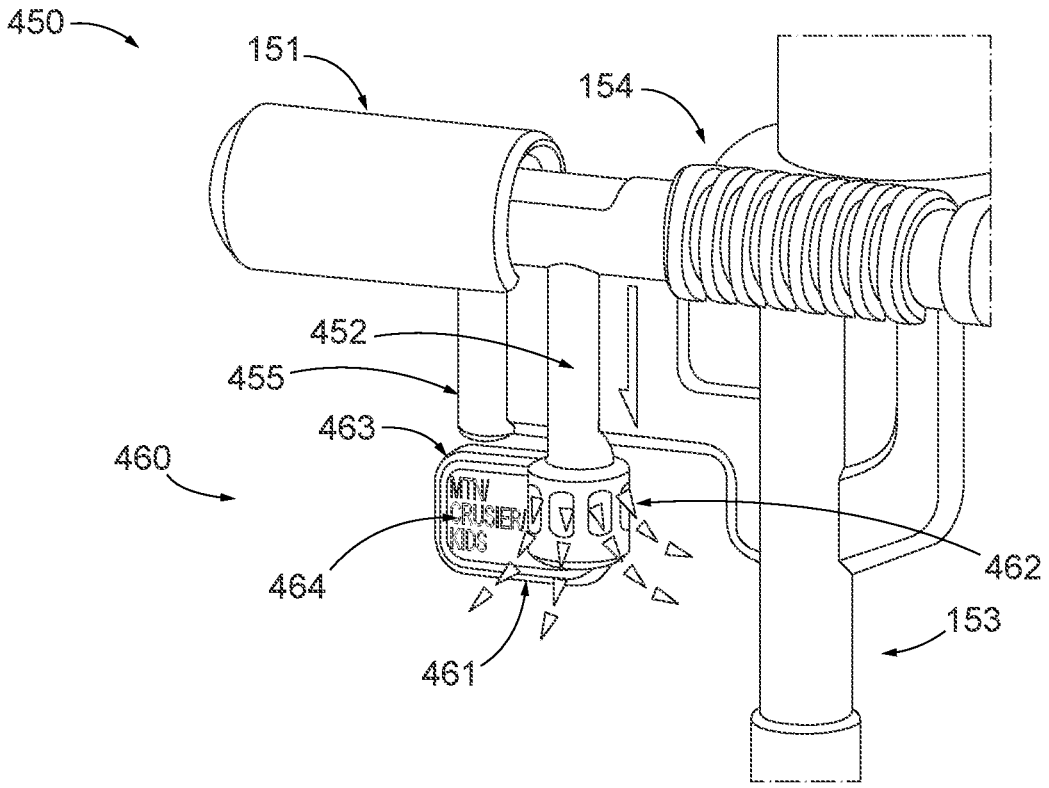
FIG. 4D shows a perspective view of a pressure regulator comprising two pressure set points wherein a selector is oriented to select for a lower blow-off setting according to an embodiment of the disclosed subject matter.
Figure 4E:
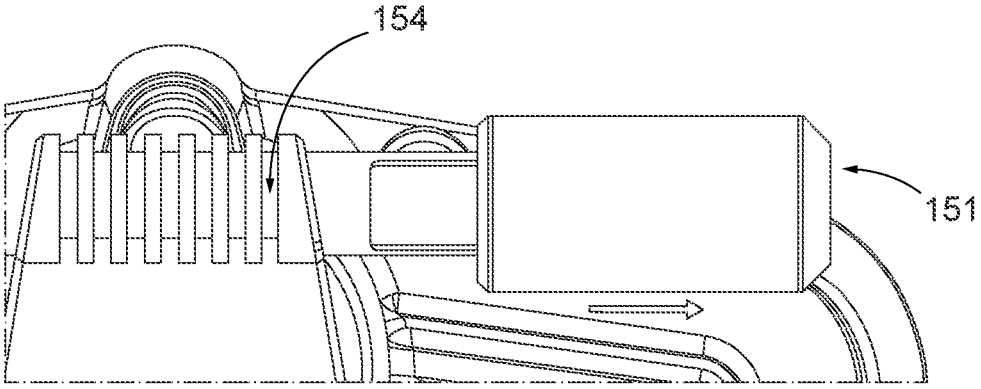
FIG. 4E shows a top view of a pressure regulator comprising two pressure set points wherein a selector is oriented to select for a lower blow-off setting according to an embodiment of the disclosed subject matter.

An exemplary embodiment of a pressure regulator with two blow off settings is illustrated in FIGS. 4D through 4G. FIGS. 4D and 4E respectively show side and top perspective views of a pressure regulator 450 with two blow off settings wherein the blow off is set to blow off (vent) air from the lower pressure set point. In the illustrated embodiment, a first blow off vent 452 is positioned on the pressure regulator 450 so that it will vent air from the air passage 154 at a lower pressure such as 40 psi (276 kPa), analogous to blow off vent 152 in FIGS. 1 and 2. A second blow off vent 455 is positioned at a position so that it will vent air from the air passage 154 at a higher pressure such as 70 psi (483 kPa). A selector mechanism 460 comprises a rotatable cap 461 on the end of blow off vent 452 at a first position. At the first position, fenestrations or vent(s) 462 are in fluid communication with opening(s) at the end of blow off vent 452 so that air can flow from the interior of air passage 154 through vent 452 and out of vent 462 when the pressure reaches 40 psi (276 kPa). As discussed above for pressure regulator 150, the cap 151 and connected piston 155 can move distally as air pressure inside air passage 154 increases, as shown by the arrow in the top perspective view (FIG. 4E). When pressure inside air passage 154 reaches the lower pressure setting, i.e. at 40 psi (276 kPa), the cap 151 and connected piston 155 have moved distally such that the opening 152*a* is uncovered by piston 155. At that point, air can flow out of air passage 154 through opening 152*a*, blow off vent 452 and vent 462, as shown by the arrow heads. Selector cap 460 also comprises lever 463, which facilitates rotating cap 461 and serves as a visual indicator for which pressure blow off setting is selected. Indicia 464 on lever 463 may be included to aid the user in knowing which pressure setting is selected.

Figure 4F:
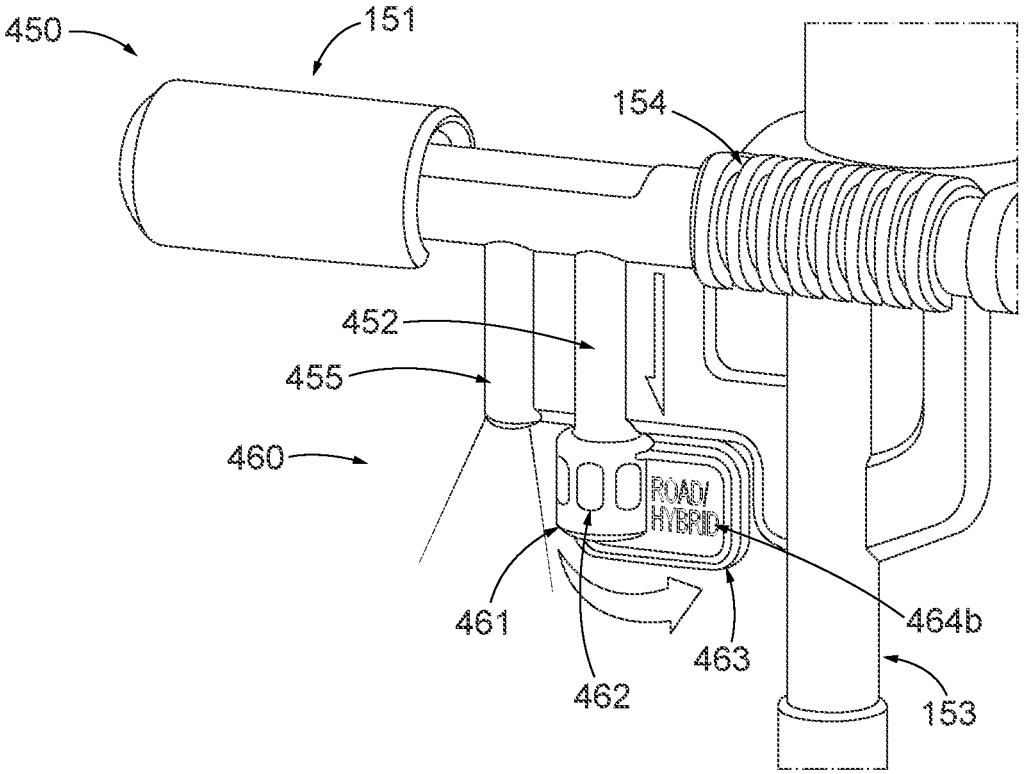
FIG. 4F shows a perspective view of a pressure regulator comprising two pressure set points wherein a selector is oriented to select for a higher blow-off setting according to an embodiment of the disclosed subject matter.
Figure 4G:
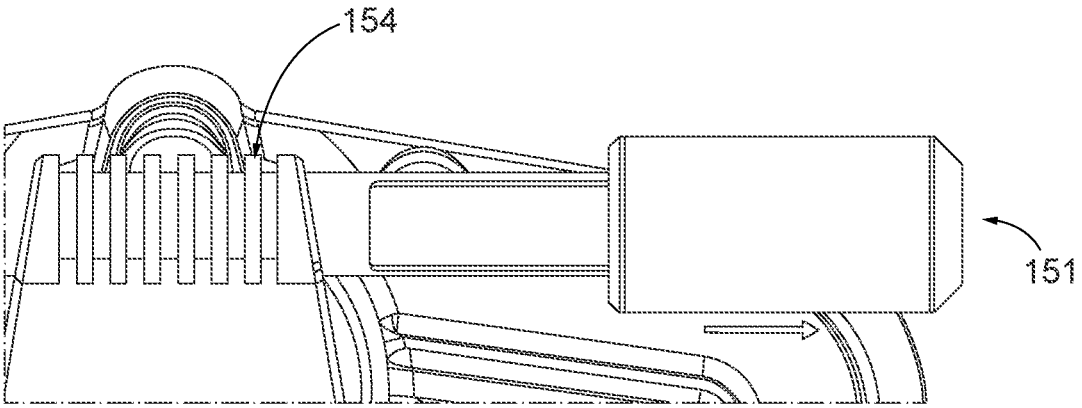
FIG. 4G shows a top view of a pressure regulator comprising two pressure set points wherein a selector is oriented to select for a higher blow-off setting according to an embodiment of the disclosed subject matter.

FIGS. 4F and 4G respectively show side and top perspective views of a pressure regulator 450 with two blow off settings wherein the blow off is set to blow off (vent) air from the higher pressure set point. Selector mechanism 460 comprises the rotatable cap 461 on the end of blow off vent 452 rotated in the direction indicated by the open arrow to move from the first position (see FIG. 4D) to a second position (FIG. 4F). Rotating cap 461 to the second position blocks air from air passage 154 from flowing out vent 452, thereby disabling the blow off setting at the lower pressure (e.g. 40 psi (276 kPa)) and enabling the pump to continue pumping to higher pressure. It can be seen that lever 463 is also moved to the second position, serving as a visual indicator for which pressure blow off setting is selected. Indicia 464*b* on lever 463 may also be included to aid the user in knowing which pressure setting is selected. As pressure inside air passage increases beyond the lower pressure setting, cap 151 and connected piston 155 can continue to move distally as shown by the arrow in the top perspective view (FIG. 4G). Comparison of FIGS. 4E and 4G shows cap 151 advanced farther distally (in the direction of the arrow) in FIG. 4G. A second opening (not shown), similar to opening 152*a*, is positioned in air passage 154 so that it is uncovered by piston 155 at the higher pressure setting, i.e. at 70 psi (483 kPa), and is in fluid communication with the higher pressure blow off vent 455. At that point, air can flow out of air passage 154 through the opening and blow off vent 455.

Other embodiments of a pressure regulator having two or more blow off settings may be envisioned, wherein the selector mechanism selectively blocks air from flowing out of a lower pressure setting and allows airflow out of a higher pressure setting.

Multiple pressure set points could be made that way. This could be useful for a "tunable" pressure regulator, such as one with a pressure set point for each type of sports ball. In an embodiment, the tunable pressure regulator can be a stand-alone pressure regulator that could attach to any pump to inflate objects (such as bicycle tires or different sports balls) to the correct pressure. In other embodiments, a pump with an integral tunable pressure regulator is envisioned.

A pressure regulator as described herein could be especially useful for a dual mode pump, such as described below. Pumping to the first set point would trigger the audible alert and signal the user to switch from high volume/lower pressure mode to low volume/higher pressure mode.

Embodiments of the pressure regulator described in the Summary of the Disclosed Subject Matter include the following:

The pressure regulator wherein venting of air through the opening in the sidewall of the second end of the second air passage produces a sound audible to a user of the pressure regulator.

The pressure regulator comprising a vibratory element that augments the sound of air venting through the opening in the sidewall of the second end of the second air passage.

The pressure regulator wherein the vibratory element comprises a reed.

The pressure regulator wherein decompression of the spring during venting air out of the pressure regulator pushes the proximal end of the piston back toward the junction, thereby covering the opening in the sidewall and blocking venting.

The pressure regulator comprising a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

The pressure regulator wherein the pressure set point is in a range from 30 to 50 psi (207 kPa to 345 kPa), or from 30 to 100 psi (207 kPa to 689 kPa).

The pressure regulator wherein the pressure set point is 40 psi (276 kPa).

The pressure regulator wherein the pressure set point is in a range from 60 to 100 psi (414 to 689 kPa).

The pressure regulator wherein the pressure set point is 70 psi (483 kPa).

The pressure regulator wherein the pressure set point is in a range from 4 to 20 psi (28 to 128 kPa).

The pressure regulator comprising a plurality of different pressure set points.

The pressure regulator comprising a first pressure set point of 40 psi (276 kPa) and a second pressure set point of 70 psi (483 kPa).

The pressure regulator wherein the cap is configured to rotate about an axis defined by the second end of the second air passage, wherein when the cap is rotated to be disposed at a first position the cap is slidable along the second end of the second air passage and the audible low pressure blow off is enabled and when the cap is rotated to be disposed at a second position the cap is not slidable along the second end of the second air passage and the audible low pressure blow off is disabled.

This disclosure also provides a pump comprising a pressure regulator as described above, including any of the embodiments described above alone or in combination.

Embodiments of the pump comprising the pressure regulator include the following:

The pump comprising a floor pump, a mini-pump, a frame pump or a foot pump.

The pump comprising a floor pump.

The pump comprising a dual mode pump comprising a larger diameter barrel for inflating an inflatable object with a higher volume at a lower pressure and a smaller diameter barrel for inflating an inflatable object with a lower volume at a higher pressure, wherein the pump is switchable to operate using either the larger diameter barrel or the smaller diameter barrel.

The dual mode pump wherein the smaller diameter barrel is configured to be telescopically disposed inside the larger diameter barrel and is switchable to be selectively attached to a plunger shaft attached to a handle so that the smaller diameter barrel operates reciprocally in the larger diameter barrel; or selectively attached to the larger diameter barrel so that the plunger shaft operates reciprocally in the smaller diameter barrel.

Dual Mode Pump

This invention also provides a dual mode reciprocal pump. As used herein a dual mode pump is a pump that that combines both large and small diameter barrels into one pump. A larger diameter barrel provides faster filling at lower pressures, such as below about 40 psi (276 kPa), by moving larger volumes of air through the pump. At pressures above about 40 psi (276 kPa) pumping effort may be too high for a user to use a larger diameter pump easily. A smaller diameter pump provides for easier pumping at higher pressures, but smaller volumes are moved through the pump. This may require a user to pump a smaller barrel pump significantly more times to obtain desired pressure in an inflatable object such as a bicycle tire.

Larger (e.g. 44 mm) diameter barrel floor pumps are generally reserved for bicycle tires that require lower pressure but more volume, including tires such as children's bike, mountain bike, beach cruiser or BMX tires. The large barrel allows user to quickly fill up large tires quickly due to the increased volume per stroke that a large barrel produces.

Generally, smaller (e.g. 32 mm) diameter barrel pumps are reserved for tire types that require higher pressures greater than 60 psi (414 kPa) due to the effort level required by the user. These are generally road and hybrid style bicycles that have skinny tires. An easy way to think of it is that large or fat tires are inflated using a large barrel and skinny tires are inflated using a skinny barrel.

In a dual mode pump, the user is able to select which "mode" they want to use, either a larger diameter barrel for lower pressures or a smaller diameter barrel for higher pressures.

This disclosure also provides a pump with dual mode capabilities comprising a larger diameter barrel for inflating an inflatable object with a higher volume at a lower pressure and a smaller diameter barrel telescopically disposed within the larger diameter barrel or inflating an inflatable object with a lower volume at a higher pressure as described above in the Summary of the Disclosed Subject Matter.

The dual mode pump disclosed herein combines both a small (for example, 32 mm inner diameter) and large (for example, 44 mm inner diameter) barrel floor pumps into one unit. In the instance where the user has a variety of different bicycles with both skinny and fat tires, a dual mode pump is a desirable pump that works universally well and most efficiently.

FIG. 5A is a front perspective view of a floor pump with a dual mode according to an embodiment of the disclosed subject matter. The dual mode pump 500 comprises a selector lever 510 that allows a user to switch the pump between larger and smaller diameter barrels as described further below. The embodiment shown in FIG. 5A includes a rotary dial-type pressure gauge 550, but this is not limiting. Other pressure gauges may also be envisioned. A notable dual mode pump comprises a pressure regulator with an audible low-pressure blow off as described herein (e.g pressure regulator 150) or dual pressure regulator with two pressure blow offs (e.g pressure regulator 450). Other components of the dual mode pump are similar to those described for FIG. 1A and have similar designations.

The dual mode pump disclosed herein combines both a small (for example, 32 mm inner diameter) and large (for example, 44 mm inner diameter) barrel floor pumps into one unit. In the instance where the user has a variety of different bicycles with both skinny and fat tires, a dual mode pump is a desirable pump that works universally well and most efficiently.

In embodiments, the larger diameter barrel has an inner diameter from 40 to 50 mm, such as 44 mm. In embodiments, the smaller diameter barrel has an inner diameter from 25 to 35 mm, such as 32 mm.

The other benefit of the dual mode pump is improved efficiency. It allows a user to inflate an inflatable object to a first lower pressure using a large diameter barrel until pumping effort become uncomfortable and then switch to the small diameter barrel to finish inflating the object.

Figure 5B:
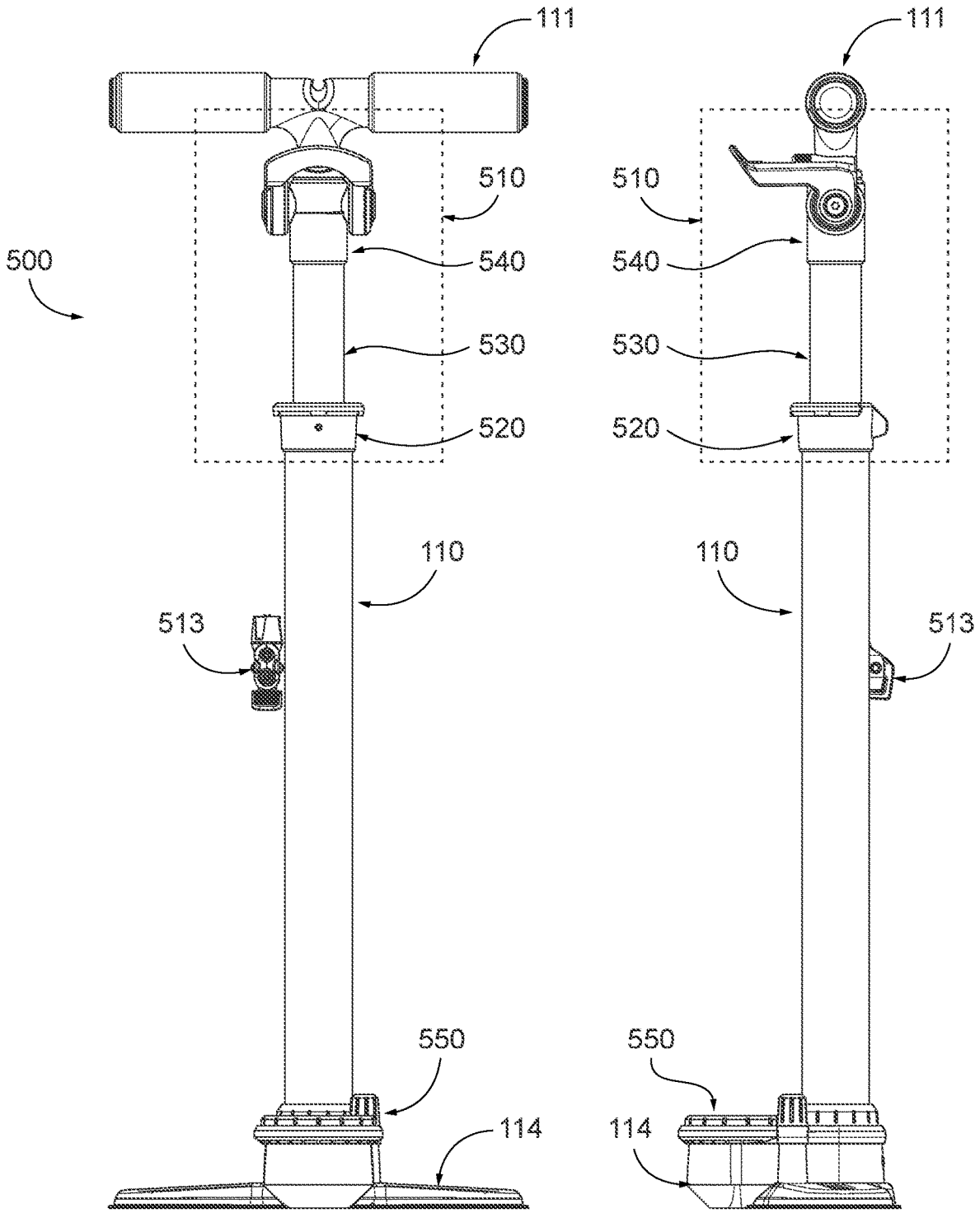
FIG. 5B shows front and side views of a floor pump with a dual mode with a selector lever up to select a high volume mode according to an embodiment of the disclosed subject matter.

As shown in FIGS. 5A and 5B, an exemplary form of the dual mode pump 500, i.e. a selective volume, two-stage air pump, generally comprises a large diameter cylinder or pump barrel 110 mounted on a base 114 and having a first upper end cap 520 for pumping in a high volume, low pressure mode. The pump also comprises a selector mechanism 510 (outlined in a dashed rectangle). FIGS. 5A and 5B show the selector mechanism 510 in a position to select the high volume, low pressure mode. Pump 500 also comprises a T-shaped handle 111, hose 112 and pumphead 513. For simplicity of illustration, hose 112 is not shown in FIG. 5B. Shown in FIGS. 5A and 5B is a rotary dial pressure gauge 550, but this is not limiting. The pump 500 further comprises a high pressure cylinder or barrel 530 telescopically extending through the first upper end cap 520 into the interior of pump barrel 110 for reciprocation within the barrel 110. The upper end of the high pressure barrel 530 is provided with a second end cap 540 through which extends a plunger shaft 560 (see FIG. 6A) having the T-shaped handle 111 at its upper end.

In accordance with the invention, the pump 500 is selectively operable as either a larger volume, low pressure pump or a smaller volume, higher pressure pump based on the position of a single selector lever 511 relative to the other parts of the pump, including the respective end caps on the low pressure cylinder 110 or the high pressure cylinder 530, the plunger shaft 560 and the handle 111.

Figure 5C:
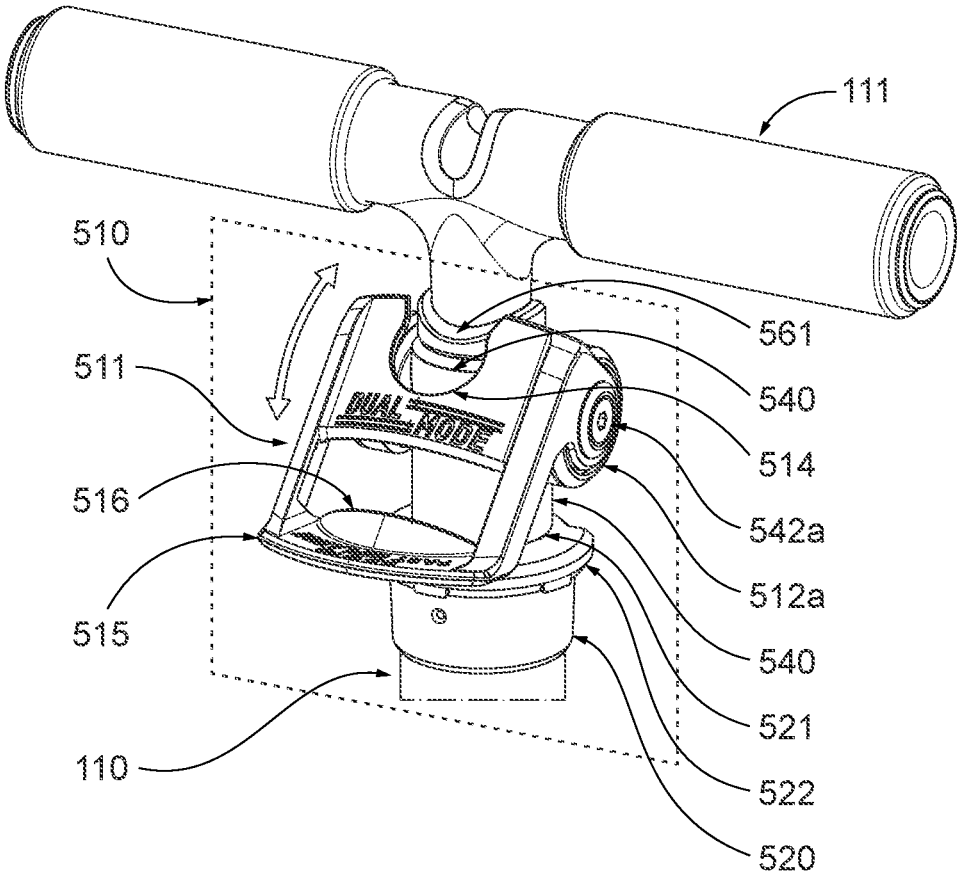
FIG. 5C is a close-up perspective view of the selector lever of a floor pump with a dual mode between first and second positions that enables selecting between high volume and low volume modes according to an embodiment of the disclosed subject matter.

FIG. 5C shows a close up view of the selection mechanism of the dual mode pump disclosed herein, comprising a single selector lever 511 that can be moved between a first position and a second position to select which mode is used by a user of the dual mode pump. In FIG. 5C the lever 511 is shown between the first and second position wherein moving lever 511 upward selects the high volume mode and moving lever 511 downward selects the low volume mode.

Selector mechanism 510 comprises a lever 511 with a specific shape to engage other parts of the pump in order to select which mode the pump is configured. Lever 511 comprises flanges 512*a* and 512*b* (not shown) on opposite sides of lever 511. Flanges 512*a* and 512*b* are configured with openings that engage hinge pins 542*a* and 542*b*, respectively, so that lever 511 can rotate from a first position to a second position. Lever 511 also comprises a flange 515 that facilitates a user moving the lever between first and second positions. Cut-out 514 (see FIG. 5C) in lever 511 is configured (shaped) so that it engages a portion of the circumference of the surface of the handle 111 and the upper face of flange 561 proximate to the handle 111. Lever 511 also comprises flange 516 configured to engage flange 522 on upper end cap 520.

The first upper end cap 520 has a central bore 521 in which the smaller high pressure barrel 530 reciprocates, an O-ring seal (not shown) being seated in the end cap around that barrel. The first upper end cap 520 also comprises a flange 522 on at least a portion of the circumference of the first upper end cap 520. The second upper end cap 540 has a central bore 543 (see FIG. 7A) in which the shaft 560 can reciprocate, an O-ring seal being seated in the end cap 540 around shaft 560. The second upper end cap 540 comprises bosses 541*a* and 541*b* on diametrically opposed sides of end cap 540 (see FIG. 5D). Bosses 541*a* and 541*b* comprise hinge pins 542*a* and 542*b*, respectively. In the embodiment shown in the Figures, hinge pins 542*a* and 542*b* comprises hex-head screws that engage threaded sockets in bosses 541*a* and 541*b*, but this is not limiting. Also shown is flange 561 proximate to the handle 111; in this embodiment flange 561 is molded into handle 111, but this is not limiting.

Figure 5D:
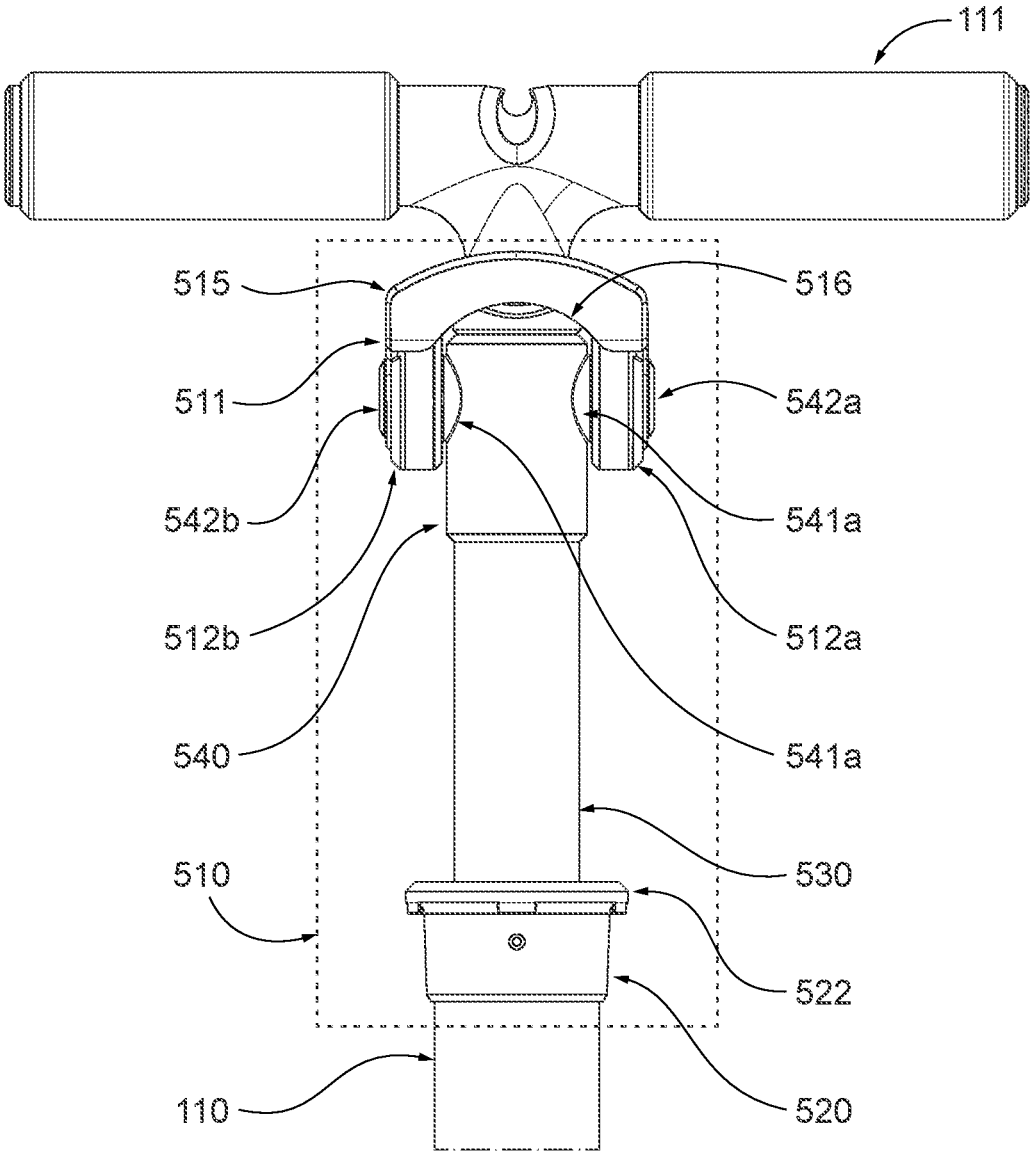
FIG. 5D is a close-up front view of the selector lever of a floor pump with a dual mode at a first position that selects the high volume mode according to an embodiment of the disclosed subject matter.

FIG. 5D is a close-up front view of the selector lever of a floor pump with a dual mode at a first (up) position that selects the high volume mode.

Selector mechanism 510 comprises a lever 511 with a specific shape to engage other parts of the pump in order to select which mode the pump is configured. Lever 511 comprises flanges 512*a* and 512*b* on opposite sides of lever 511. Flanges 512*a* and 512*b* are configured with openings that engage hinge pins 542*a* and 542*b*, respectively, so that lever 511 can rotate from a first position to a second position. Lever 511 also comprises a flange 515 that facilitates a user moving the lever between first and second positions. Cut-out 514 (see FIG. 5C) in lever 511 is configured (shaped) so that it engages a portion of the circumference of the surface of the handle 111 and the upper face of flange 561 on shaft 560 proximate to the handle 111 to lock the lever 511 to the plunger shaft 560. Because the lever 511 is attached to second end cap 540 attached to the smaller barrel 530, barrel 530 is also locked to plunger shaft 560 in this configuration.

Figure 6A:
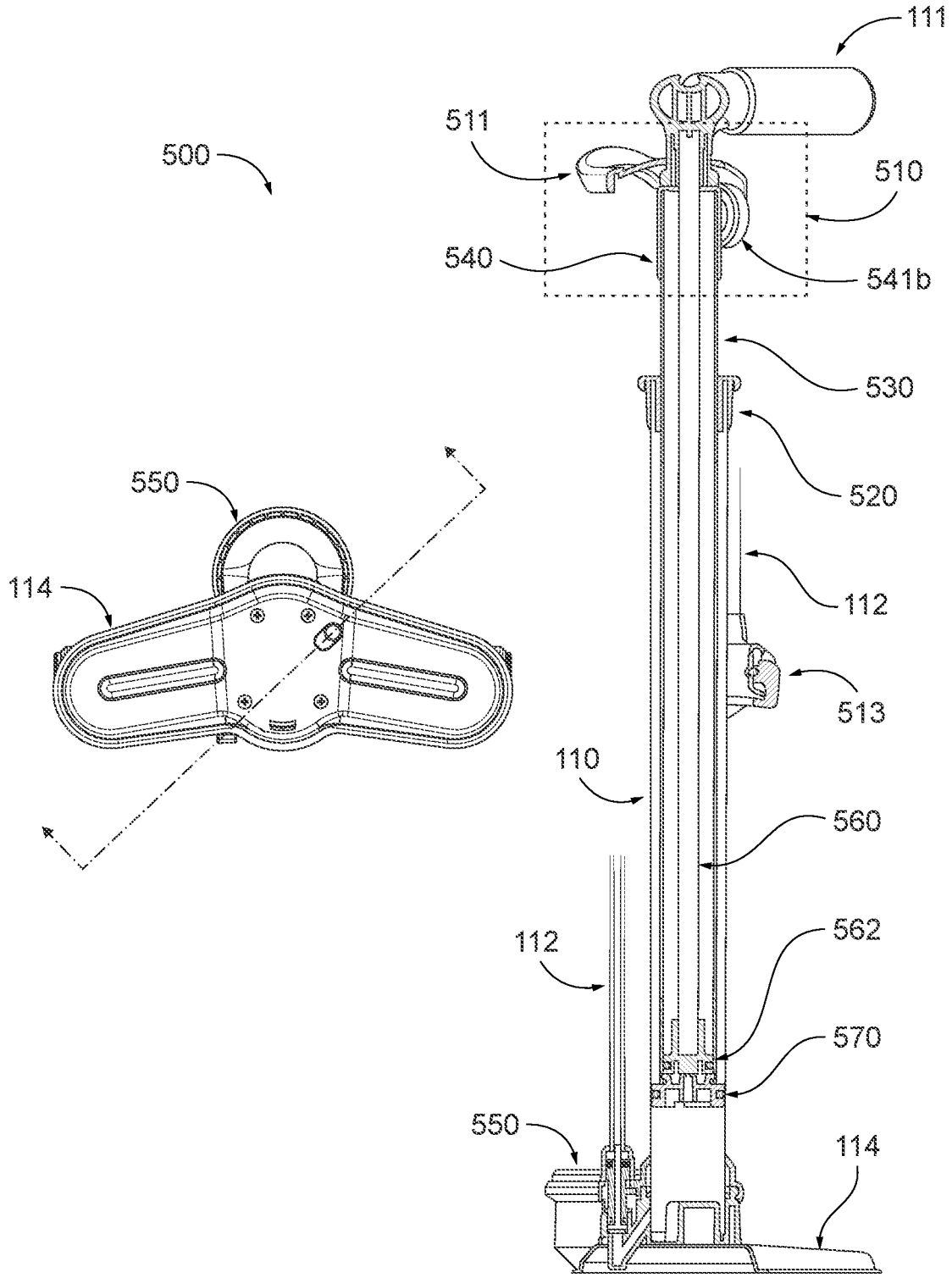
FIG. 6A shows a section view of the selector lever of a floor pump with a dual mode at a first (up) position that selects the high volume mode according to an embodiment of the disclosed subject matter.

FIG. 6A shows a section view of pump 500 wherein the selector lever 511 is in the up position, selecting the pump to operate in the high volume, low pressure mode. A plunger 562 is fixed on the lower end of the plunger shaft 560. A lower end cap 570 is fixed on the lower end of small barrel 530. Locking the smaller barrel 530 and plunger shaft 560 together locks plunger 562 against the top of the lower end cap 570, so that handle 111, plunger shaft 560, plunger 561, small barrel 530 and lower end cap 570 are all locked together to move in unison reciprocally within the interior of the larger barrel 110 when handle 111 is moved up and down.

In this configuration, lower end cap 570 operates as a plunger within the larger diameter barrel 110 and the pump is effective as a larger volume, relatively lower pressure device for fast inflation of inflatable articles such as tires.

Figure 6B:
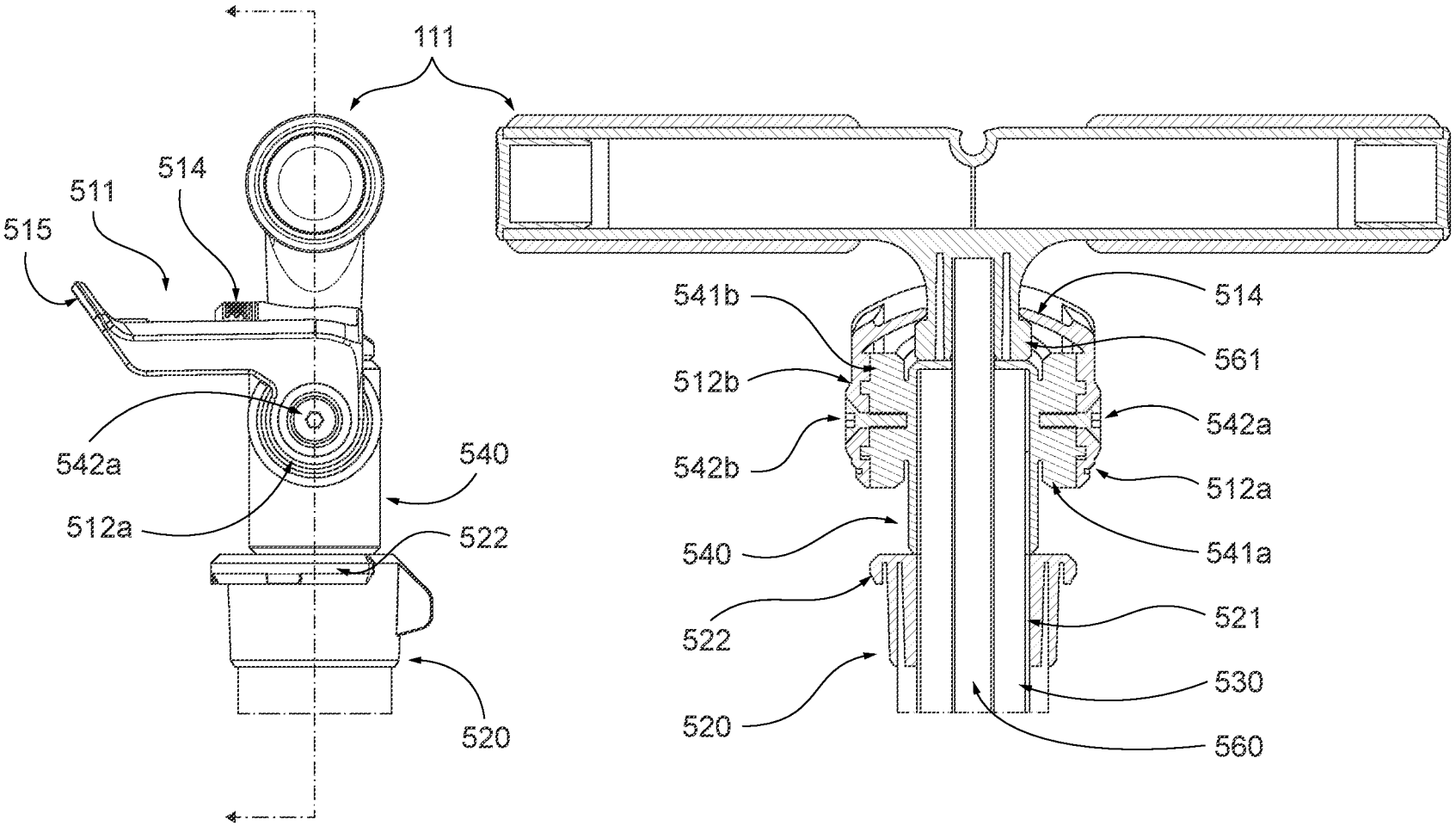
FIG. 6B shows close-up side and section views of the selector lever of a floor pump with a dual mode at a first (up) position that selects the high volume mode according to an embodiment of the disclosed subject matter.

FIG. 6B shows a close up side view and section view of the selector mechanism wherein the lever 511 is locked in the up position. The section view shows the cut-out 514 engaging the upper surface of the flange 561 so that plunger shaft 560 and small barrel 530 are locked together.

Figure 6C:
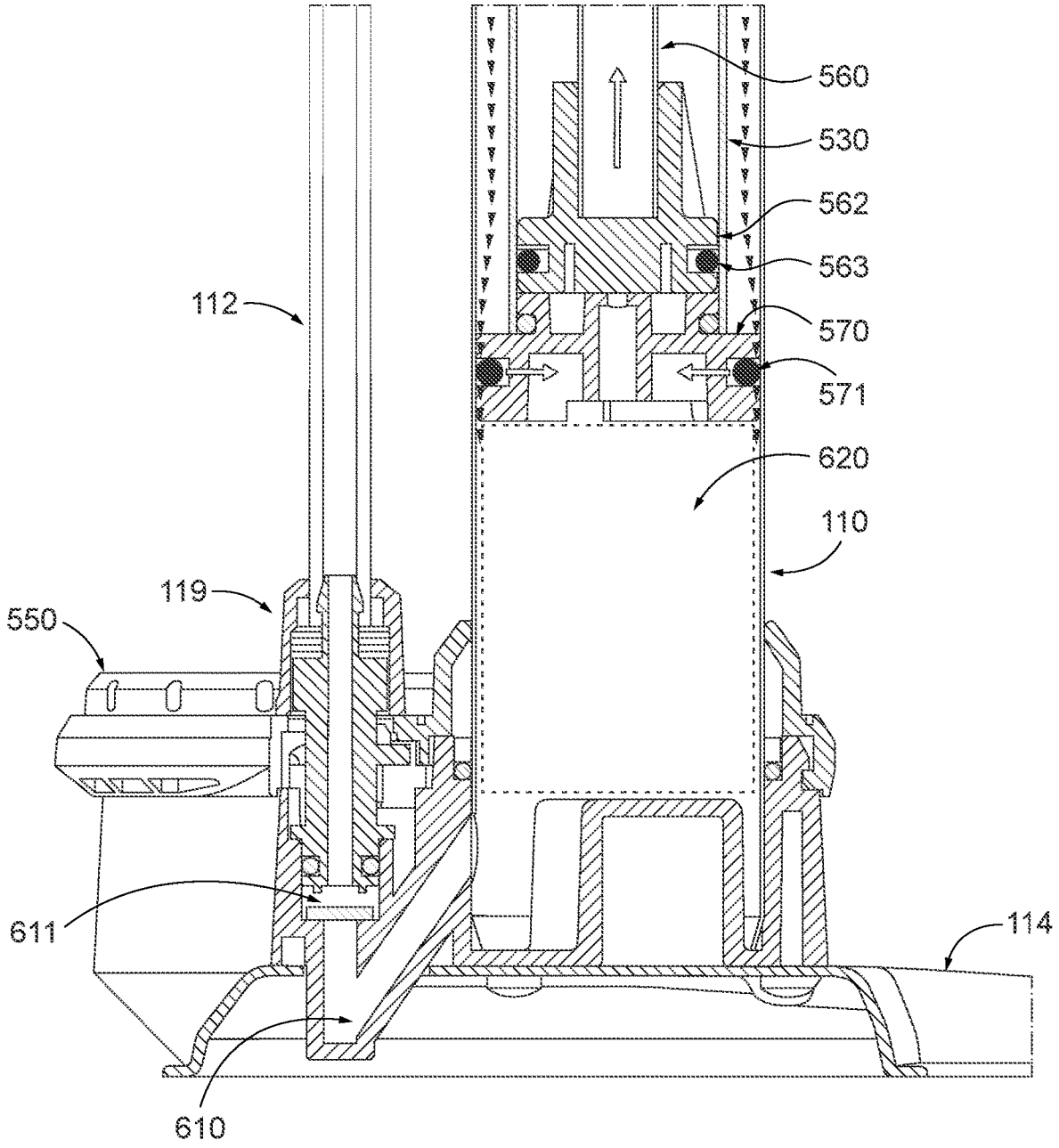
FIGS. 6C and 6D show section views of the lower end of a floor pump with a dual mode at a first (up) position that selects the high volume mode according to an embodiment of the disclosed subject matter.
Figure 6D:
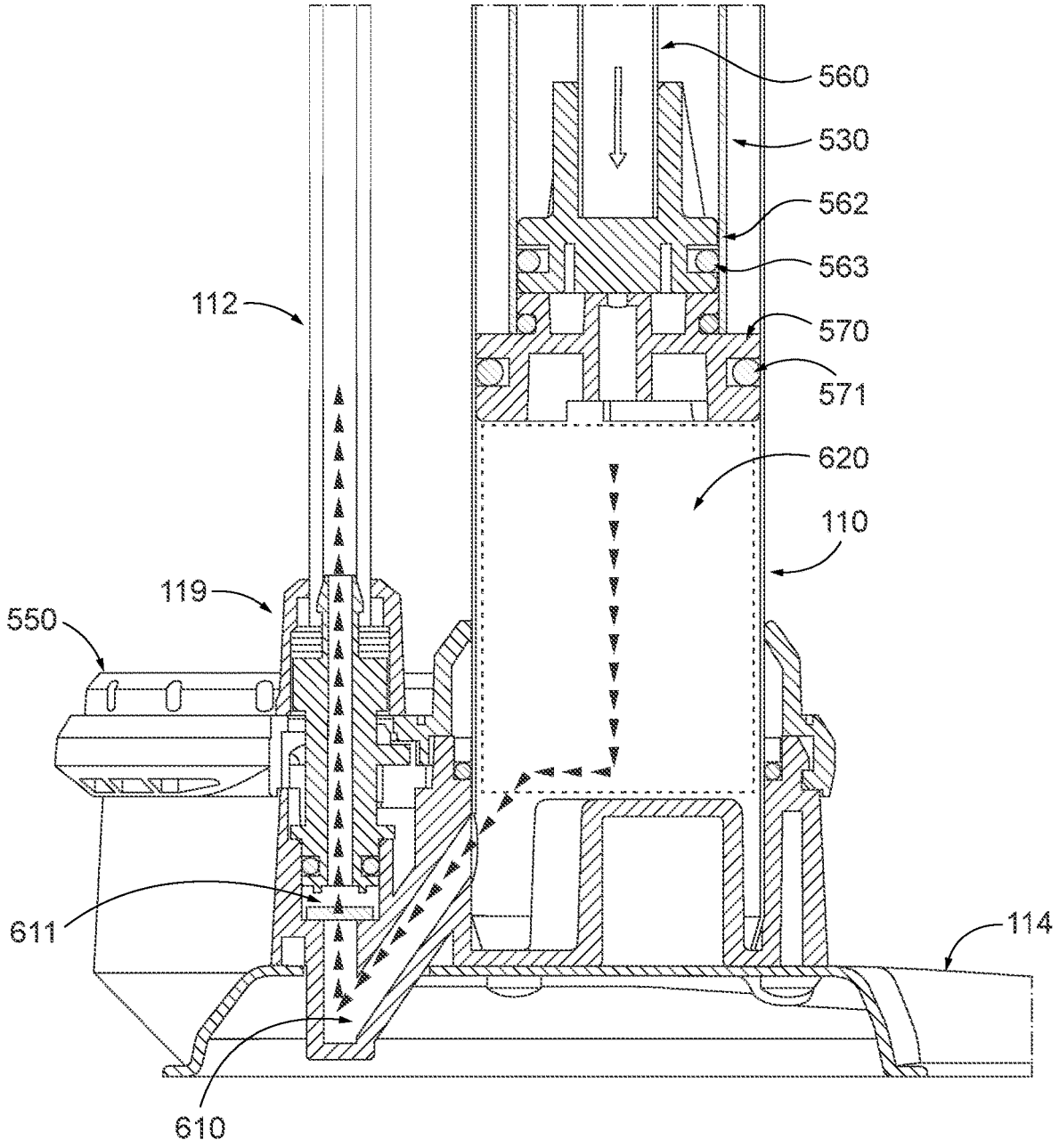

FIGS. 6C and 6D show close up section views of the lower end of pump 500 when operated in the large volume, low pressure mode. As shown in FIG. 6C, plunger 562 inside the small cylinder 530 is provided with an O-ring 563 circumferentially disposed thereon and selectively slidably engaged with the interior of small barrel 530 to provide a substantially air-tight seal. When the lever 511 is engaged in the up position to select the high volume mode, plunger 562 is locked in the bottom of small barrel 530 and engaged with the top of lower end cap 570, blocking fluid communication between the interior of large barrel 110 and the interior of small barrel 530. The lower end cap 570 of the smaller diameter barrel 530 inside the larger barrel 110 is provided with an O-ring 571 circumferentially disposed thereon and slidably engaged with the interior of larger barrel 110 to provide a substantially air-tight seal. The base 114 comprises a one-way check valve 611 disposed in an outlet passage 610 leading from the interior of barrel 110 to outlet port 119. The check valve in the outlet passage allows air flow out of the interior of barrel 110 but not into the interior of barrel 110. The area bounded by the dashed rectangle 620 is proportional to the volume of air inside the large barrel 110 as handle 111 is moved up and down.

In operation, outlet 119 and an article to be inflated are connected, such as via hose 112 and pumphead 513. When handle 111 (not shown) and connected plunger shaft 560 are moved upward as in FIG. 6C, suction from inside barrel 110 in volume 620 pulls O-ring 571 inward as shown by the arrows, providing a clearance gap to form an inlet passage. Air from the outside of the pump 500 can pass into the interior of large barrel 110 via the created inlet passage as shown by the chain of arrowheads and the volume of air 620 increases.

When plunger shaft 560 is moved downward as shown in FIG. 6D, pressure from within volume 620 pushes O-ring 571 outward, blocking the inlet passage so that air cannot exit volume 620 in that direction. In effect, O-ring 571 functions as a one-way check valve. Air is pushed out of the interior of the large barrel 110, decreasing the volume of air 620, through the outlet passage 610, past check valve 611 to the outlet port 119, hose 112 and to the inflatable object, as indicated by the line of arrowheads. Channels in the outlet passage are in fluid communication with pressure gauge 550 so that a portion of air exiting the pump can be sampled to measure its pressure.

Figure 7A:
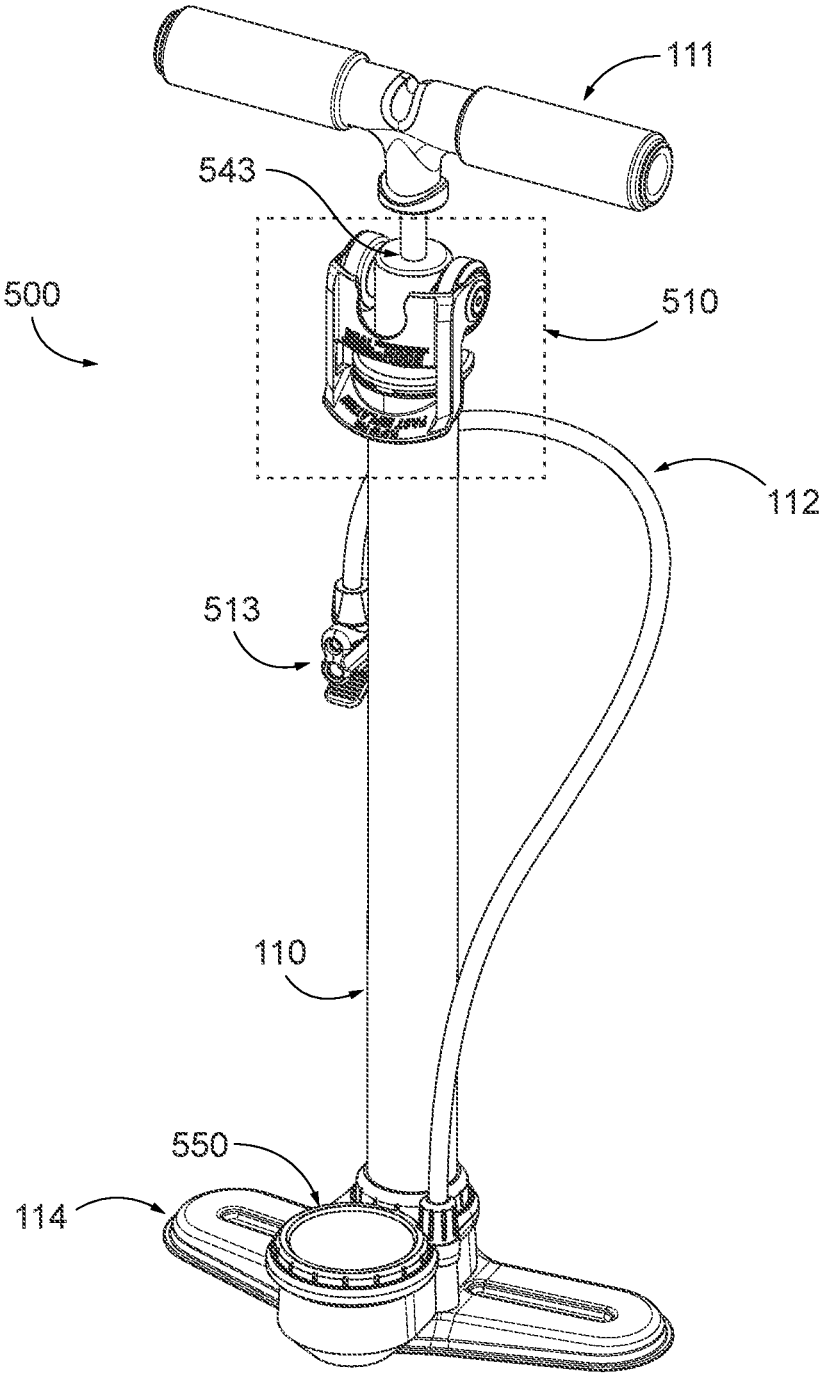
FIG. 7A shows a perspective view of a floor pump with a dual mode with a selector lever down to select a low volume mode according to an embodiment of the disclosed subject matter.
Figure 7B:
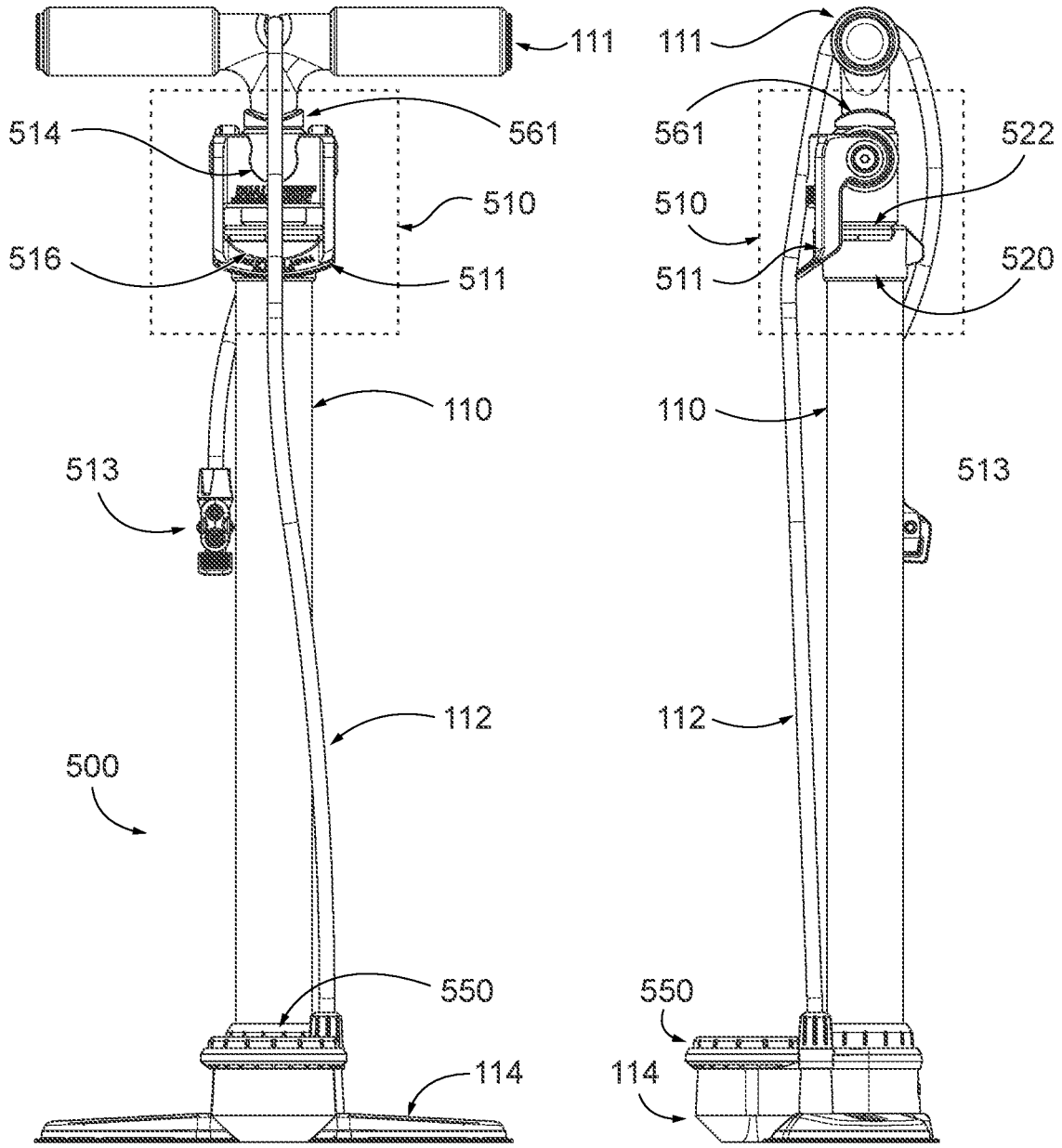
FIG. 7B shows front and side views of a floor pump with a dual mode with a selector lever down to select a low volume mode according to an embodiment of the disclosed subject matter.

FIGS. 7A and 7B show perspective, front and side views of the pump 500 with the selector lever 511 in the second (down) position, enabling the pump to be operated as a low volume, high pressure pump.

Figure 7C:
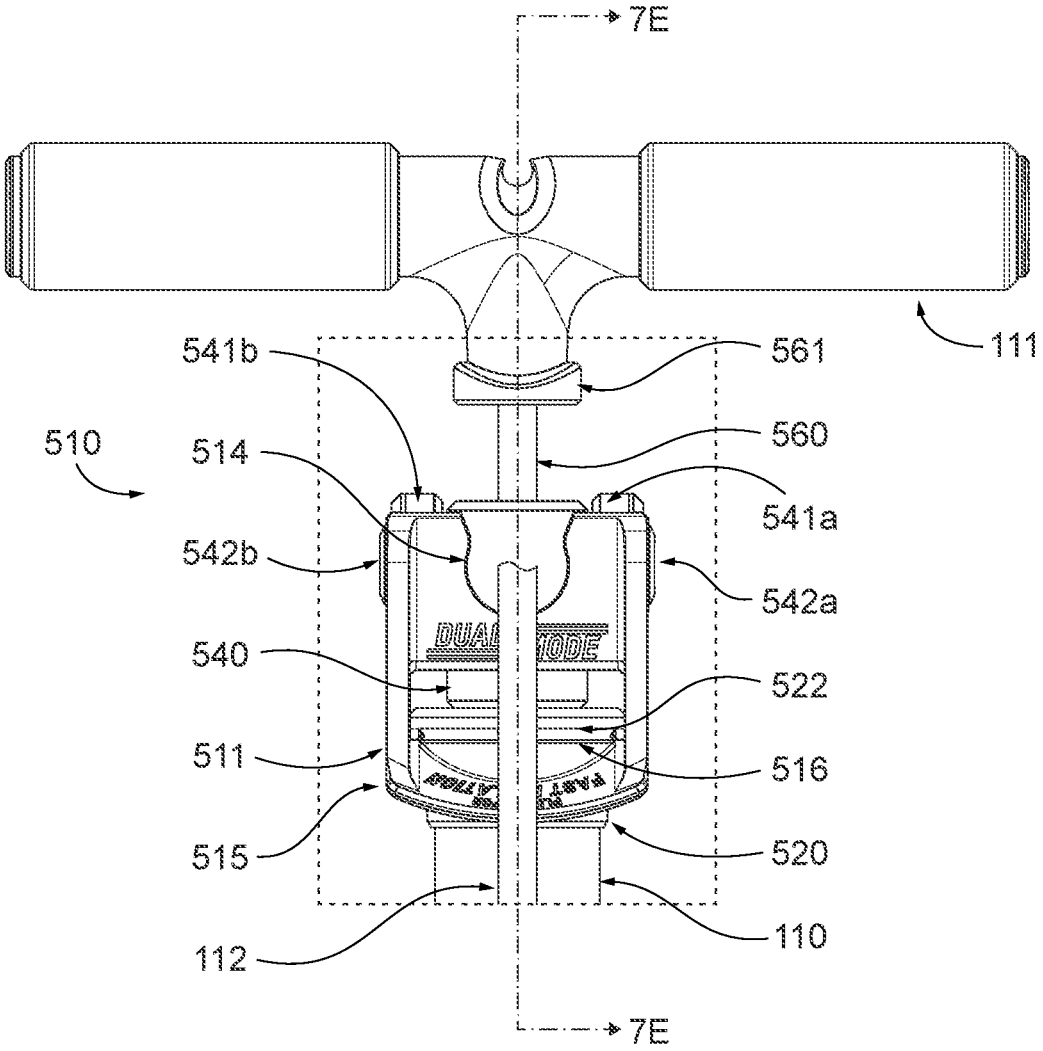
FIG. 7C is a close-up front view of the selector lever of a floor pump with a dual mode at a second (down) position that selects the low volume mode according to an embodiment of the disclosed subject matter.
Figure 7D:
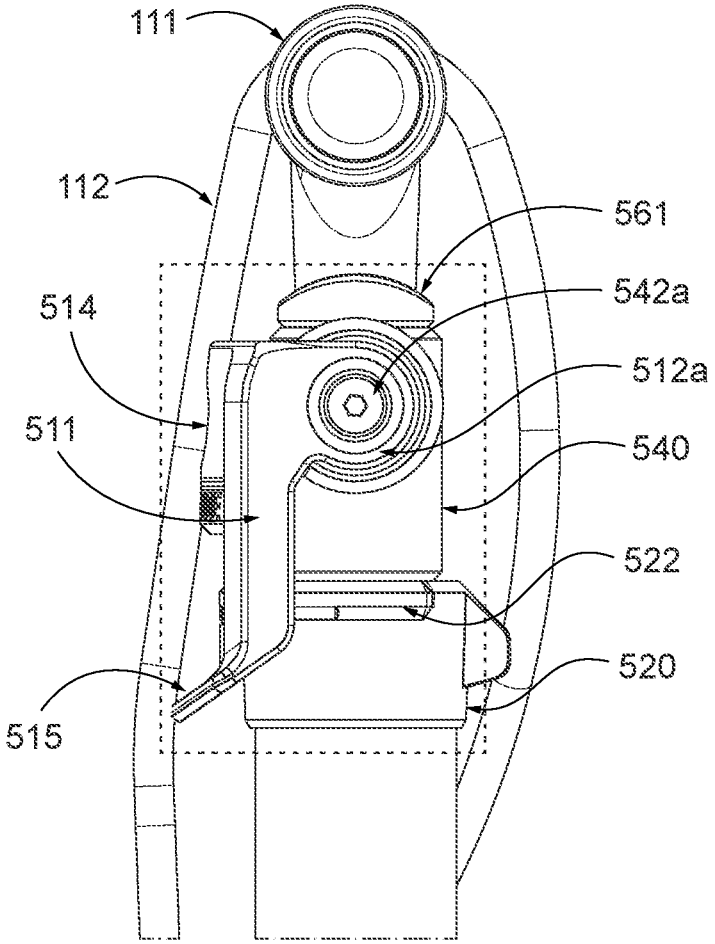
FIG. 7D is a close-up side view of the selector lever of a floor pump with a dual mode at a second (down) position that selects the low volume mode according to an embodiment of the disclosed subject matter.

FIG. 7C is a close-up front view of the selector lever of a floor pump with a dual mode at a second (down) position that selects the low volume mode. FIG. 7D is a close-up side view of the selector lever of a floor pump with a dual mode at a second (down) position that selects the low volume mode. When the pump handle 111 is worked up and down with the lever engaged in the down position, the plunger inside the small cylinder 530 is operative and the pump is effective as a lower volume relatively higher pressure device for easy inflation at higher pressure.

When the article is inflated to the point that operation of the pump becomes difficult due to pressure in the article, the lever 511 is rotated into the second or "down" position as shown in FIG. 7C and FIG. 7D. Opening 516 is configured to engage the bottom face of flange 522 on first end cap 520. A portion of lever 511 proximate to opening 516 is configured (shaped) so that it engages a portion of the circumference of the surface of the first end cap 520. In this configuration, the top of smaller barrel 530 is locked to the top of the larger barrel 110, locking the smaller barrel within the larger barrel 110 so that it cannot move reciprocally within the larger barrel 110. Rotation of lever 511 downward also disengages cut-out 514 from the upper face of flange 561 and the outer surface of handle 111. As a result, plunger shaft 560 is unlocked, allowing it to move the plunger 562 attached thereto reciprocally within small barrel 530.

Figure 7E:
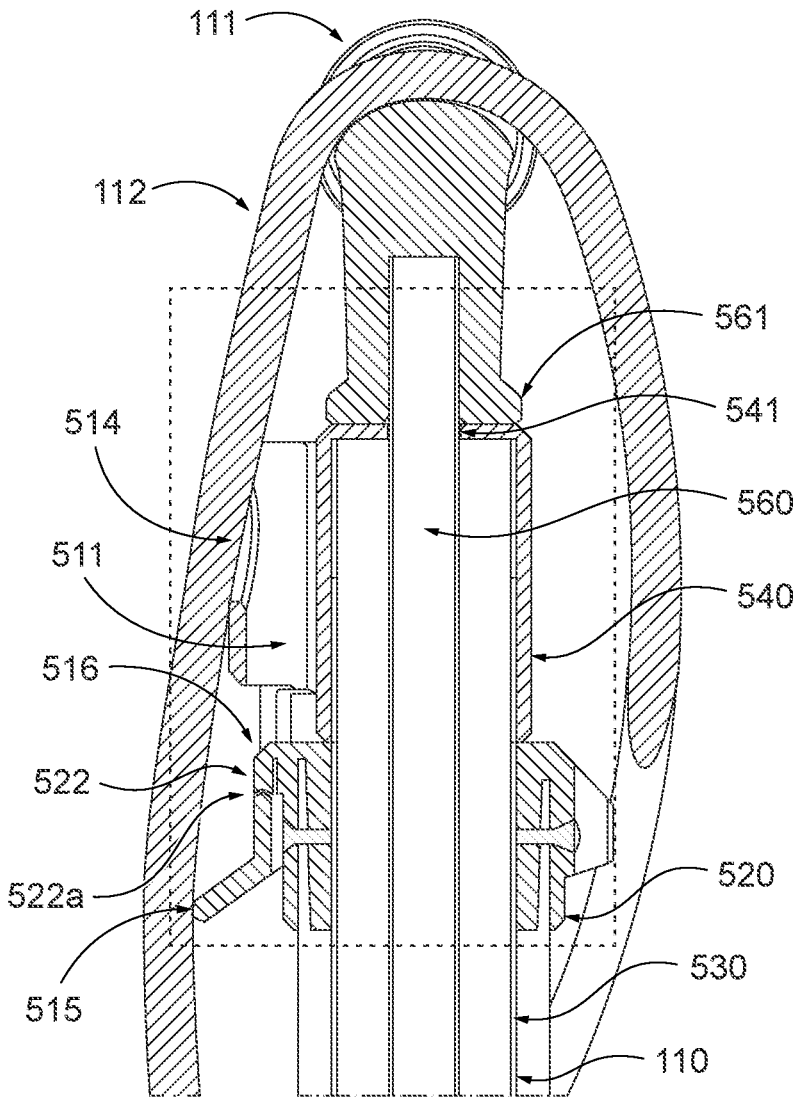
FIG. 7E shows a section view of the selector lever of a floor pump with a dual mode at a second (down) position that selects the high volume mode according to an embodiment of the disclosed subject matter.

FIG. 7E is a close-up section view of the selector lever of a floor pump with a dual mode at a second (down) position that selects the low volume mode. This view shows that the opening 516 engages the lower face 522*a* of flange 522.

Figure 7F:
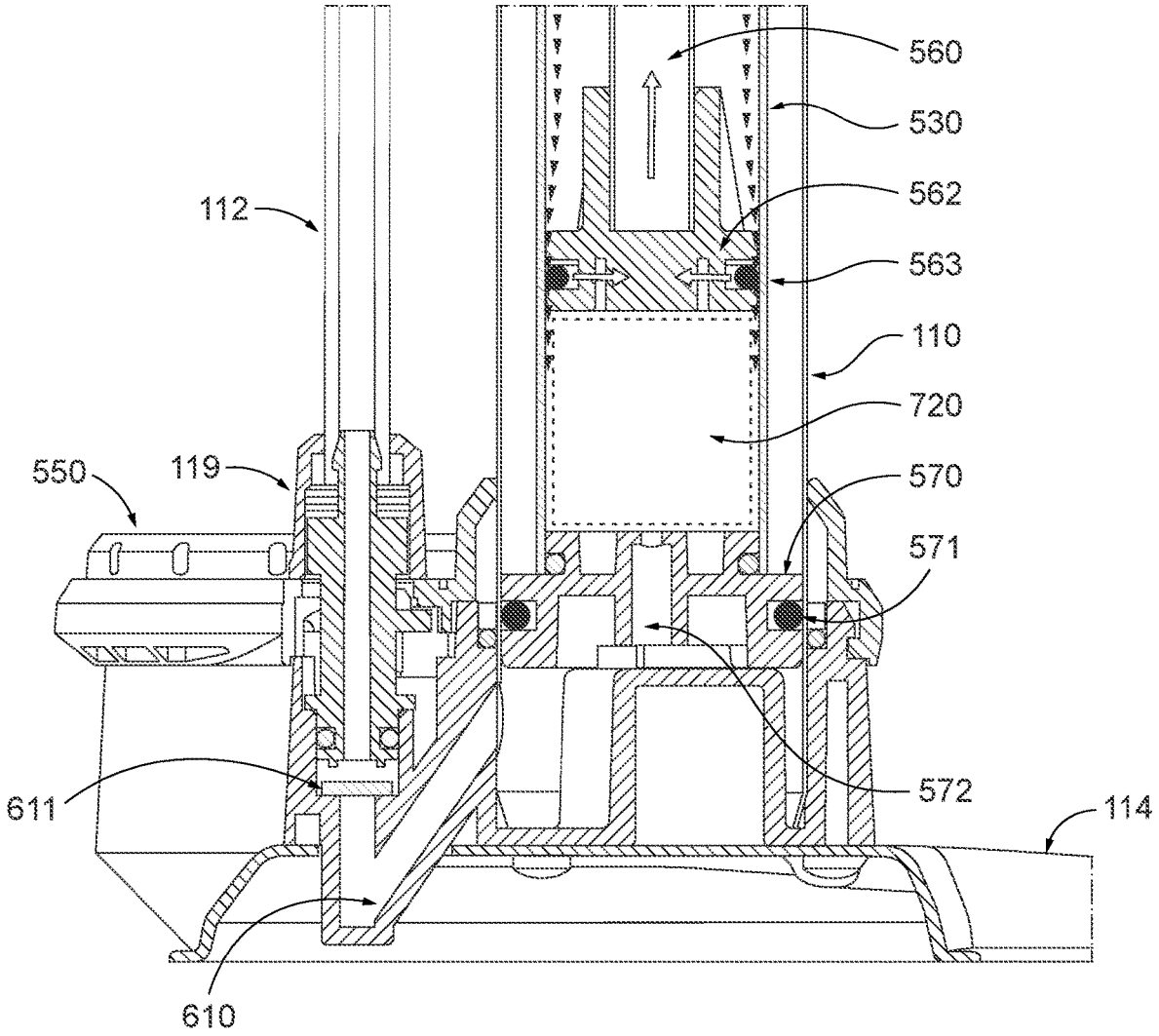
FIGS. 7F and 7G shows section views of the lower end of a floor pump with a dual mode at a second (down) position that selects the low volume mode according to an embodiment of the disclosed subject matter.
Figure 7G:
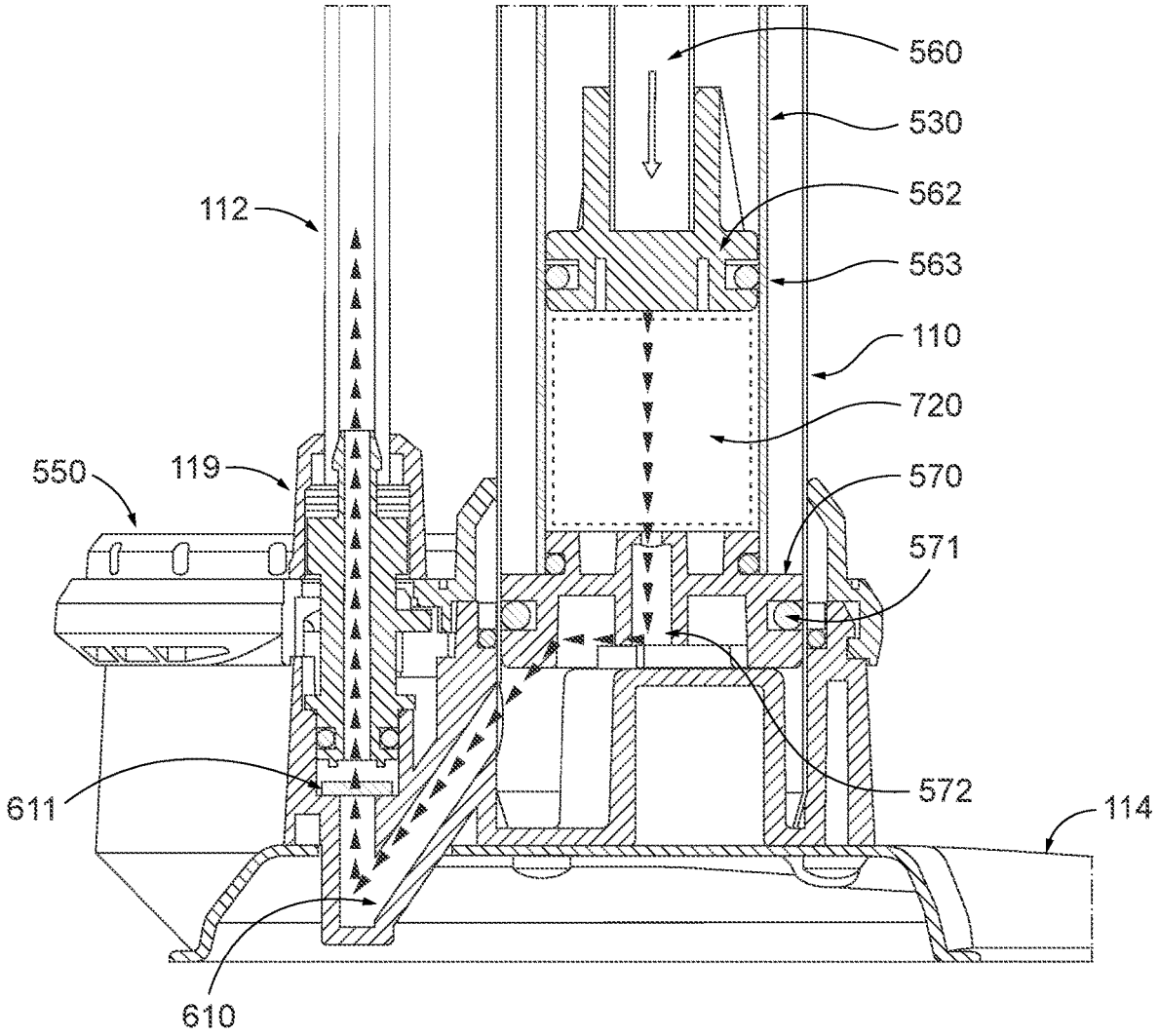

FIGS. 7F and 7G show close up section views of the lower end of pump 500 when operated in the low volume, high pressure mode. The bottom of the lower end cap 570 of small barrel 530 comprises an outlet 572. The outlet 572 is aligned with outlet 610 at the bottom of the larger barrel 110 to selectively provide fluid communication between the interior of the smaller diameter barrel 530 and the interior of the larger diameter barrel 110. The area bounded by the dashed rectangle 720 is proportional to the volume of air inside the large barrel 530 as handle 111 and connected plunger shaft 560 is moved up and down.

In the low volume mode, the bottom of the lower end cap 570 is locked in contact with the bottom of the large barrel 110 so that the outlet 572 at the bottom of the smaller barrel 530 is in fluid communication with the outlet at the bottom of the larger barrel 110.

In operation in the low volume mode, when plunger shaft 560 is moved upward as in FIG. 7F, suction from inside barrel 530 in volume 720 pulls O-ring 563 inward as shown by the arrows, providing a clearance gap to form an inlet passage. Air from the outside of the pump 500 can pass into the interior of smaller barrel 530 via the created inlet passage as shown by the chain of arrowheads and the volume of air 720 increases.

When plunger shaft 562 is moved downward as shown in FIG. 7G, pressure from within volume 720 pushes O-ring 563 outward, blocking the inlet passage so that air cannot exit volume 720 in that direction. In effect, O-ring 563 functions as a one-way check valve. Air is pushed out of the interior of the smaller barrel 530, decreasing the volume of air 720, through the outlet passage 610, past check valve 611 to the outlet port 119, hose 112 and to the inflatable object, as indicated by the line of arrowheads.

For illustration, if a user has a tire that requires higher pressure, they can start off by flipping the selector lever up which enables the larger barrel (44 mm) and allows for large volumes of air per stroke. This will prime the tire quickly with less strokes. Once the pumping starts to get difficult due to the pressure building, the user can then flip the selector lever down to enable the small barrel (32 mm). This will allow the user to reach the higher pressures with much less effort per stroke. Switching modes is a great added benefit.

The diameters of the cylinders and the pressures described above are not limiting. The operating principles described herein can be used can be used with other sizes of dual mode pumps. For illustration, the cylinder diameters may be smaller when used in a dual mode frame pump.

For illustration, instead of a bicycle tire, the inflatable object may be an inflatable water craft such as an inflatable raft, inflatable stand-up paddle board, inflatable kayak or boats comprising inflatable buoyancy elements and rigid hull elements such as a rigid inflatable boat (RIB), also known as a rigid-hull inflatable boat or rigid-hulled inflatable boat (RHIB). These watercraft require more air volume than bicycle tires, so larger volume pumps may be desirable for inflating them. Conversely, they may be inflated to lower pressures than bicycle tires. For example, a dual mode pump as described herein may comprise a first, large diameter, high volume pump barrel may be used to inflate the inflatable water craft to about 3 psi (21 kPa), and then a user can switch to the smaller diameter pump mode to raise the pressure to about 7 psi (48 kPa).

A notable dual mode pump as described herein comprises a pressure regulator having an audible pressure blow off as described herein. For example, pressure gauge 550 in FIGS. 5, 6 and 7 could be replaced with pressure regulator 150 as shown in FIG. 1A or pressure regulator 450 as shown in FIG. 4D through 4G. As described above, a user could begin pumping a higher pressure tire (e.g. one that requires inflation to over 60 psi (414 kPa) using the high volume, low pressure mode with mode selection lever 511 in the up position and the selector cap 151 in the low pressure audible blow off setting (see FIGS. 3A, 3B, 4A and 4B). When the pressure reaches the blow off pressure (e.g. 40 psi (276 kPa)), the audible alert will sound, informing the user to switch to the low volume, high pressure mode by moving the mode selection lever 511 to the down position and rotating the selector cap 151 to the high pressure setting wherein the audible low pressure blow off is disabled. This will allow the user to finish inflating the tire to its required pressure using the low volume, high pressure mode.

Alternatively, a user could begin pumping a higher pressure tire (e.g. one that requires inflation to over 60 psi (414 kPa)) using the high volume, low pressure mode with mode selection lever 511 in the up position and the selector cap 461 in the low pressure audible blow off setting (see FIGS. 4D and 4E). When the pressure reaches the blow off pressure (e.g. 40 psi (276 kPa)), the audible alert will sound, informing the user to switch to the low volume, high pressure mode by moving the mode selection lever 511 to the down position and rotating the selector cap 461 to the high pressure setting wherein the audible low pressure blow off is disabled and the audible high pressure blow off is enabled. This will allow the user to finish inflating the tire to its required pressure using the low volume, high pressure mode and determining that the pressure has reached the desired high pressure setting when the high pressure audible sound is heard.

Replacing the pressure gauge 550 by positioning the pressure regulator 150 or pressure regulator 450 at the base of dual mode pump near the floor stand is not limiting. For example, the pressure regulator 150 or pressure regulator 450 may be disposed proximate to the handle 111 and selector lever 511 at the upper end of floor pump 500. Disposition of the pressure regulator 150 at this location puts the selector cap 151 in proximity to the mode selection lever 511 so that both selectors are within convenient reach by the user. Disposition of the pressure regulator 450 at this location puts the selector cap 461 in proximity to the mode selection lever 511 so that both selectors are within convenient reach by the user. In an embodiment, pump 500 may comprise both a pressure gauge such as 550 and a pressure regulator 150 or pressure regulator 450.

Embodiments of the pump with dual mode capabilities described above include the following:

The pump comprising a floor pump, a mini-pump, a frame pump or a foot pump.

The pump comprising a floor pump.

The pump wherein the larger diameter barrel has an inner diameter of about 44 mm.

The pump wherein the smaller diameter barrel has an inner diameter of about 32 mm.

The pump further comprising a pressure regulator comprising a first air passage wherein a first end of the first air passage is configured to be in fluid communication with an outlet of a pump and a second end of the first air passage forms a junction with a second air passage having a first end and a second end wherein the junction of the first air passage is disposed between the first and second ends of the second air passage;

wherein the first end of the second air passage is configured to be in fluid communication with an inflatable object;

wherein the second end of the second air passage comprises a piston disposed therein, wherein the piston is slidingly engaged with the interior surface of the second end of the air passage and a distal end of the piston passes through an opening in the distalmost end of second end of the second air passage and is attached an inner surface of a base of a cap having a side wall attached to at least a portion of the base and disposed overlying and slidingly engaged with at least a portion of the exterior surface of the second end of the second air passage; a coil spring disposed around the piston and inside the second end of the second air passage; an opening in the side wall of the second end of the second air passage in fluid communication with a vent to the air external to the pressure regulator; wherein the piston and attached cap are configured to move distally away from the junction as pressure inside the second end of the second air passage increases, wherein the coil spring is in a non-compressed state when the interior of the pressure regulator is not pressurized and is in a compressed state when the interior of the pressure regulator is pressurized; when the pressure inside the second air passage is at or below a defined set point, the opening is blocked by the piston, and when the pressure inside the second air passage is above a defined set point, the opening is not blocked by the piston and air from inside the second air passage is vented to the air external to the pressure regulator.

The pump wherein venting of air through the opening in the sidewall of the second end of the second air passage produces a sound audible to a user of the pump.

The pump wherein the pressure regulator comprises a vibratory element that augments the sound of air venting through the opening in the sidewall of the second end of the second air passage.

The pump wherein the vibratory element comprises a reed.

The pump wherein decompression of the spring during venting air out of the pressure regulator pushes the proximal end of the piston back toward the junction, thereby covering the opening in the sidewall and blocking venting.

The pump wherein the pressure regulator comprises a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

The pump wherein the pressure set point of the pressure regulator is in a range from 30 to 50 psi (207 kPa to 345 kPa), or from 30 to 100 psi (207 kPa to 689 kPa).

The pump wherein the pressure set point of the pressure regulator is 40 psi (276 kPa).

The pump wherein the pressure set point of the pressure regulator is in a range from 60 to 100 psi (414 to 689 kPa).

The pump wherein the pressure set point of the pressure regulator is 70 psi (483 kPa).

The pump wherein the pressure set point of the pressure regulator is in a range from 4 to 20 psi (28 to 128 kPa).

The pump wherein the pressure regulator comprises a plurality of different pressure set points.

The pump wherein the pressure regulator comprises a first pressure set point of 40 psi (276 kPa) and a second pressure set point of 70 psi (483 kPa).

The pump wherein the cap of the pressure regulator is configured to rotate about an axis defined by the second end of the second air passage, wherein when the cap is rotated to be disposed at a first position the cap is slidable along the second end of the second air passage and the audible low pressure blow off is enabled and when the cap is rotated to be disposed at a second position the cap is not slidable along the second end of the second air passage and the audible low pressure blow off is disabled.

A notable dual mode pump comprises a dual mode pump switchable between higher volume low pressure operation and lower pressure high pressure operation and a pressure regulator with an audible low pressure blow off is described in the Summary of the Disclosed Subject Matter above. Embodiments of the pump include the following:

The pump comprising a floor pump, a mini-pump, a frame pump or a foot pump.

The pump comprising a floor pump.

The pump wherein the larger diameter barrel has an inner diameter of about 44 mm.

The pump wherein the smaller diameter barrel has an inner diameter of about 32 mm.

The pump wherein venting of air through the opening in the sidewall of the second end of the second air passage produces a sound audible to a user of the pump.

The pump wherein the pressure regulator comprises a vibratory element that augments the sound of air venting through the opening in the sidewall of the second end of the second air passage.

The pump wherein the vibratory element comprises a reed.

The pump wherein decompression of the spring during venting air out of the pressure regulator pushes the proximal end of the piston back toward the junction, thereby covering the opening in the sidewall and blocking venting.

The pump wherein the pressure regulator comprises a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

The pump wherein the pressure set point of the pressure regulator is in a range from 30 to 50 psi (207 kPa to 345 kPa), or from 30 to 100 psi (207 kPa to 689 kPa).

The pump wherein the pressure set point of the pressure regulator is 40 psi (276 kPa).

The pump wherein the pressure set point of the pressure regulator is in a range from 60 to 100 psi (414 to 689 kPa).

The pump wherein the pressure set point of the pressure regulator is 70 psi (483 kPa).

The pump wherein the pressure set point of the pressure regulator is in a range from 4 to 20 psi (28 to 128 kPa).

The pump wherein the pressure regulator comprises a plurality of different pressure set points.

The pump wherein the pressure regulator comprises a first pressure set point of 40 psi (276 kPa) and a second pressure set point of 70 psi (483 kPa).

The pump wherein the cap of the pressure regulator is configured to rotate about an axis defined by the second end of the second air passage, wherein when the cap is rotated to be disposed at a first position the cap is slidable along the second end of the second air passage and the audible low pressure blow off is enabled and when the cap is rotated to be disposed at a second position the cap is not slidable along the second end of the second air passage and the audible low pressure blow off is disabled.

Embodiments of the invention include the following, alone or in any combination.

Embodiment 1. A pressure regulator comprising a first air passage wherein a first end of the first air passage is configured to be in fluid communication with an outlet of a pump and a second end of the first air passage forms a junction with a second air passage having a first end and a second end wherein the junction of the first air passage is disposed between the first and second ends of the second air passage; wherein the first end of the second air passage is configured to be in fluid communication with an inflatable object; wherein the second end of the second air passage comprises a piston disposed therein, wherein the piston is slidingly engaged with the interior surface of the second end of the air passage and a distal end of the piston passes through an opening in the distalmost end of second end of the second air passage and is attached an inner surface of a base of a cap having a side wall attached to at least a portion of the base and disposed overlying and slidingly engaged with at least a portion of the exterior surface of the second end of the second air passage; a coil spring disposed around the piston and inside the second end of the second air passage; an opening in the side wall of the second end of the second air passage in fluid communication with a vent to the air external to the pressure regulator; wherein the piston and attached cap are configured to move distally away from the junction as pressure inside the second end of the second air passage increases, wherein the coil spring is in a non-compressed state when the interior of the pressure regulator is not pressurized and is in a compressed state when the interior of the pressure regulator is pressurized; when the pressure inside the second air passage is at or below a defined set point, the opening is blocked by the piston, and when the pressure inside the second air passage is above a defined set point, the opening is not blocked by the piston and air from inside the second air passage is vented to the air external to the pressure regulator.

Embodiment 2. The pressure regulator of Embodiment 1 wherein venting of air through the opening in the sidewall of the second end of the second air passage produces a sound audible to a user of the pressure regulator.

Embodiment 3. The pressure regulator of Embodiment 2 comprising a vibratory element that augments the sound of air venting through the opening in the sidewall of the second end of the second air passage.

Embodiment 4. The pressure regulator of Embodiment 3 wherein the vibratory element comprises a reed.

Embodiment 5. The pressure regulator of Embodiment 1 wherein decompression of the spring during venting air out of the pressure regulator pushes the proximal end of the piston back toward the junction, thereby covering the opening in the sidewall and blocking venting.

Embodiment 6. The pressure regulator of Embodiment 1 comprising a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

Embodiment 7. The pressure regulator of Embodiment 1 wherein the pressure set point is in a range from 30 to 50 psi (207 kPa to 345 kPa).

Embodiment 7a. The pressure regulator of Embodiment 1 wherein the pressure set point is in a range from 30 to 100 psi (207 kPa to 689 kPa).

Embodiment 8. The pressure regulator of Embodiment 7 wherein the pressure set point is 40 psi (276 kPa).

Embodiment 9. The pressure regulator of Embodiment 1 wherein the pressure set point is in a range from 60 to 100 psi (414 to 689 kPa).

Embodiment 10. The pressure regulator of Embodiment 9 wherein the pressure set point is 70 psi (483 kPa).

Embodiment 11. The pressure regulator of Embodiment 1 wherein the pressure set point is in a range from 4 to 20 psi (28 to 128 kPa).

Embodiment 12. The pressure regulator of Embodiment 1 comprising a plurality of different pressure set points.

Embodiment 13. The pressure regulator Embodiment 12 comprising a first pressure set point of 40 psi (276 kPa) and a second pressure set point of 70 psi (483 kPa).

Embodiment 14. The pressure regulator of Embodiment 1 wherein the cap is configured to rotate about an axis defined by the second end of the second air passage, wherein when the cap is rotated to be disposed at a first position the cap is slidable along the second end of the second air passage and the audible low pressure blow off is enabled and when the cap is rotated to be disposed at a second position the cap is not slidable along the second end of the second air passage and the audible low pressure blow off is disabled.

Embodiment 15. A pump comprising the pressure regulator of Embodiment 1.

Embodiment 16. The pump of Embodiment 15 comprising a floor pump, a mini-pump, a frame pump or a foot pump.

Embodiment 17. The pump of Embodiment 16 comprising a floor pump.

Embodiment 18. The pump of Embodiment 15 comprising a dual mode pump comprising a larger diameter barrel for inflating an inflatable object with a higher volume at a lower pressure and a smaller diameter barrel for inflating an inflatable object with a lower volume at a higher pressure, wherein the pump is switchable to operate using either the larger diameter barrel or the smaller diameter barrel.

Embodiment 19. The pump of Embodiment 18 wherein the smaller diameter barrel is configured to be telescopically disposed inside the larger diameter barrel and is switchable to be selectively attached to a plunger shaft attached to a handle so that the smaller diameter barrel operates reciprocally in the larger diameter barrel; or selectively attached to the larger diameter barrel so that the plunger shaft operates reciprocally in the smaller diameter barrel.

Embodiment 20. A pump comprising a larger diameter barrel for inflating an inflatable object with a higher volume at a lower pressure and a smaller diameter barrel telescopically disposed within the larger diameter barrel or inflating an inflatable object with a lower volume at a higher pressure; wherein the pump comprises a lever rotatably attached to an upper end cap of the smaller diameter barrel; wherein when the lever is rotated to a first position wherein the lever is engaged with a portion of the circumference of the surface of a handle and an upper face of a flange on a plunger shaft proximate to the handle to lock the lever and the upper end cap of the smaller diameter barrel to the plunger shaft, whereby moving the plunger shaft up and down moves the smaller diameter barrel reciprocally within the larger diameter barrel and the pump is effective as a larger volume relatively lower pressure device; and wherein when the lever is rotated to a second position wherein the lever is engaged with a portion of the circumference of a surface of an upper end cap of the larger diameter barrel and a lower face of a flange on the upper end cap of the larger diameter barrel to lock the lever and the upper end cap of the smaller diameter barrel to the upper end cap of the larger diameter barrel, whereby moving the plunger shaft up and down moves a plunger at the bottom of the plunger shaft reciprocally within the smaller diameter barrel and the pump is effective as a smaller volume relatively higher pressure device.

Embodiment 21. The pump of Embodiment 20 wherein the larger diameter barrel has an inner diameter of about 44 mm.

Embodiment 22. The pump of Embodiment 20 wherein the smaller diameter barrel has an inner diameter of about 32 mm.

Embodiment 23. The pump of Embodiment 20 comprising a floor pump, a mini-pump, a frame pump or a foot pump.

Embodiment 24. The pump of Embodiment 23 comprising a floor pump.

Embodiment 25. The pump of Embodiment 20 further comprising a pressure regulator comprising a first air passage wherein a first end of the first air passage is configured to be in fluid communication with an outlet of a pump and a second end of the first air passage forms a junction with a second air passage having a first end and a second end wherein the junction of the first air passage is disposed between the first and second ends of the second air passage; wherein the first end of the second air passage is configured to be in fluid communication with an inflatable object; wherein the second end of the second air passage comprises a piston disposed therein, wherein the piston is slidingly engaged with the interior surface of the second end of the air passage and a distal end of the piston passes through an opening in the distalmost end of second end of the second air passage and is attached an inner surface of a base of a cap having a side wall attached to at least a portion of the base and disposed overlying and slidingly engaged with at least a portion of the exterior surface of the second end of the second air passage; a coil spring disposed around the piston and inside the second end of the second air passage; an opening in the side wall of the second end of the second air passage in fluid communication with a vent to the air external to the pressure regulator; wherein the piston and attached cap are configured to move distally away from the junction as pressure inside the second end of the second air passage increases, wherein the coil spring is in a non-compressed state when the interior of the pressure regulator is not pressurized and is in a compressed state when the interior of the pressure regulator is pressurized; when the pressure inside the second air passage is at or below a defined set point, the opening is blocked by the piston, and when the pressure inside the second air passage is above a defined set point, the opening is not blocked by the piston and air from inside the second air passage is vented to the air external to the pressure regulator.

Embodiment 26. The pump of Embodiment 25 wherein venting of air through the opening in the sidewall of the second end of the second air passage produces a sound audible to a user of the pump.

Embodiment 27. The pump of Embodiment 26 wherein the pressure regulator comprises a vibratory element that augments the sound of air venting through the opening in the sidewall of the second end of the second air passage.

Embodiment 28. The pump of Embodiment 27 wherein the vibratory element comprises a reed.

Embodiment 29. The pump of Embodiment 25 wherein decompression of the spring during venting air out of the pressure regulator pushes the proximal end of the piston back toward the junction, thereby covering the opening in the sidewall and blocking venting.

Embodiment 30. The pump of Embodiment 25 wherein the pressure regulator comprises a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

Embodiment 31. The pump of Embodiment 25 wherein the pressure set point of the pressure regulator is in a range from 30 to 50 psi (207 kPa to 345 kPa).

Embodiment 31a. The pump of Embodiment 25 wherein the pressure set point of the pressure regulator is in a range from 30 to 100 psi (207 kPa to 689 kPa).

Embodiment 32. The pump of Embodiment 25 wherein the pressure set point of the pressure regulator is 40 psi (276 kPa).

Embodiment 33. The pump of Embodiment 25 wherein the pressure set point of the pressure regulator is in a range from 60 to 100 psi (414 to 689 kPa).

Embodiment 34. The pump of Embodiment 25 wherein the pressure set point of the pressure regulator is 70 psi (483 kPa).

Embodiment 35. The pump of Embodiment 25 wherein the pressure set point of the pressure regulator is in a range from 4 to 20 psi (28 to 128 kPa).

Embodiment 36. The pump of Embodiment 25 wherein the pressure regulator comprises a plurality of different pressure set points.

Embodiment 37. The pump of Embodiment 25 wherein the pressure regulator comprises a first pressure set point of 40 psi (276 kPa) and a second pressure set point of 70 psi (483 kPa).

Embodiment 38. The pump of Embodiment 25 wherein the cap of the pressure regulator is configured to rotate about an axis defined by the second end of the second air passage, wherein when the cap is rotated to be disposed at a first position the cap is slidable along the second end of the second air passage and the audible low pressure blow off is enabled and when the cap is rotated to be disposed at a second position the cap is not slidable along the second end of the second air passage and the audible low pressure blow off is disabled.

Embodiment 39. A pump comprising a larger diameter barrel for inflating an inflatable object with a higher volume at a lower pressure and a smaller diameter barrel telescopically disposed within the larger diameter barrel or inflating an inflatable object with a lower volume at a higher pressure; wherein the pump comprises a lever rotatably attached to an upper end cap of the smaller diameter barrel; wherein when the lever is rotated to a first position wherein the lever is engaged with a portion of the circumference of the surface of a handle and an upper face of a flange on a plunger shaft proximate to the handle to lock the lever and the upper end cap of the smaller diameter barrel to the plunger shaft, whereby moving the plunger shaft up and down moves the smaller diameter barrel reciprocally within the larger diameter barrel and the pump is effective as a larger volume relatively lower pressure device; wherein when the lever is rotated to a second position wherein the lever is engaged with a portion of the circumference of a surface of an upper end cap of the larger diameter barrel and a lower face of a flange on the upper end cap of the larger diameter barrel to lock the lever and the upper end cap of the smaller diameter barrel to the upper end cap of the larger diameter barrel, whereby moving the plunger shaft up and down moves a plunger at the bottom of the plunger shaft reciprocally within the smaller diameter barrel and the pump is effective as a smaller volume relatively higher pressure device; and a pressure regulator comprising a first air passage wherein a first end of the first air passage is configured to be in fluid communication with an outlet of a pump and a second end of the first air passage forms a junction with a second air passage having a first end and a second end wherein the junction of the first air passage is disposed between the first and second ends of the second air passage; wherein the first end of the second air passage is configured to be in fluid communication with an inflatable object; wherein the second end of the second air passage comprises a piston disposed therein, wherein the piston is slidingly engaged with the interior surface of the second end of the air passage and a distal end of the piston passes through an opening in the distalmost end of second end of the second air passage and is attached an inner surface of a base of a cap having a side wall attached to at least a portion of the base and disposed overlying and slidingly engaged with at least a portion of the exterior surface of the second end of the second air passage; a coil spring disposed around the piston and inside the second end of the second air passage; an opening in the side wall of the second end of the second air passage in fluid communication with a vent to the air external to the pressure regulator; wherein the piston and attached cap are configured to move distally away from the junction as pressure inside the second end of the second air passage increases, wherein the coil spring is in a non-compressed state when the interior of the pressure regulator is not pressurized and is in a compressed state when the interior of the pressure regulator is pressurized; when the pressure inside the second air passage is at or below a defined set point, the opening is blocked by the piston, and when the pressure inside the second air passage is above a defined set point, the opening is not blocked by the piston and air from inside the second air passage is vented to the air external to the pressure regulator.

Embodiment 40. The pump of Embodiment 39 wherein the larger diameter barrel has an inner diameter of about 44 mm.

Embodiment 41. The pump of Embodiment 39 wherein the smaller diameter barrel has an inner diameter of about 32 mm.

Embodiment 42. The pump of Embodiment 39 comprising a floor pump, a mini-pump, a frame pump or a foot pump.

Embodiment 43. The pump of Embodiment 42 comprising a floor pump.

Embodiment 44. The pump of Embodiment 39 wherein venting of air through the opening in the sidewall of the second end of the second air passage produces a sound audible to a user of the pump.

Embodiment 45. The pump of Embodiment 44 wherein the pressure regulator comprises a vibratory element that augments the sound of air venting through the opening in the sidewall of the second end of the second air passage.

Embodiment 46. The pump of Embodiment 45 wherein the vibratory element comprises a reed.

Embodiment 47. The pump of Embodiment 39 wherein decompression of the spring during venting air out of the pressure regulator pushes the proximal end of the piston back toward the junction, thereby covering the opening in the sidewall and blocking venting.

Embodiment 48. The pump of Embodiment 39 wherein the pressure regulator comprises a visual indicator wherein the sidewall of the cap overlays substantially the entire length of the second end of the second air passage when the pressure regulator is not pressurized and the cap slides distally along the exterior surface of the second end of the second air passage and exposes indicia under the sidewall of the cap indicating a pressurized state as pressure increases.

Embodiment 49. The pump of Embodiment 39 wherein the pressure set point of the pressure regulator is in a range from 30 to 50 psi (207 kPa to 345 kPa).

Embodiment 49a. The pump of Embodiment 39 wherein the pressure set point of the pressure regulator is in a range from 30 to 100 psi (207 kPa to 689 kPa).

Embodiment 50. The pump of Embodiment 39 wherein the pressure set point of the pressure regulator is 40 psi (276 kPa).

Embodiment 51. The pump of Embodiment 39 wherein the pressure set point of the pressure regulator is in a range from 60 to 100 psi (414 to 689 kPa).

Embodiment 52. The pump of Embodiment 39 wherein the pressure set point of the pressure regulator is 70 psi (483 kPa).

Embodiment 53. The pump of Embodiment 39 wherein the pressure set point of the pressure regulator is in a range from 4 to 20 psi (28 to 128 kPa).

Embodiment 54. The pump of Embodiment 39 wherein the pressure regulator comprises a plurality of different pressure set points.

Embodiment 55. The pump of Embodiment 39 wherein the pressure regulator comprises a first pressure set point of 40 psi (276 kPa) and a second pressure set point of 70 psi (483 kPa).

Embodiment 56. The pump of Embodiment 39 wherein the cap of the pressure regulator is configured to rotate about an axis defined by the second end of the second air passage, wherein when the cap is rotated to be disposed at a first position the cap is slidable along the second end of the second air passage and the audible low pressure blow off is enabled and when the cap is rotated to be disposed at a second position the cap is not slidable along the second end of the second air passage and the audible low pressure blow off is disabled.

The invention claimed is:

1. A pump comprising a pressure regulator comprising a first air passage wherein a first end of the first air passage is configured to be in fluid communication with an outlet of the pump and a second end of the first air passage forms a junction with a second air passage having a first end and a second end wherein the junction of the first air passage with the second air passage is disposed between the first and second ends of the second air passage;

wherein the first end of the second air passage is configured to be in fluid communication with an inflatable object;

wherein the second end of the second air passage comprises a piston disposed therein, wherein the piston is slidingly engaged with an interior surface of the second end of the second air passage and a distal end of the piston passes through an opening in the distalmost end of the second end of the second air passage and is attached to an inner surface of a base of a cap having a side wall attached to at least a portion of the base and disposed overlying and slidingly engaged with at least a portion of an exterior surface of the second end of the second air passage;

a coil spring disposed around the piston and inside the second end of the second air passage;

an opening in the side wall of the second end of the second air passage in fluid communication with a vent to air external to the pressure regulator;

wherein the cap and the piston are configured to move distally away from the junction as pressure inside the second end of the second air passage increases, wherein the coil spring is in a non-compressed state when an interior of the pressure regulator is not pressurized and is in a compressed state when the interior of the pressure regulator is pressurized; when pressure inside the second air passage is at or below a defined set point, the opening is blocked by the piston, and when pressure inside the second air passage is above the defined set point, the opening is not blocked by the piston and the air from inside the second air passage is vented to the air external to the pressure regulator.

2. The pump of claim 1 wherein venting of the air through the opening in the sidewall of the second end of the second air passage produces a sound audible to a user of the pump.

3. The pump of claim 2 comprising a vibratory element that augments the sound of the air venting through the opening in the sidewall of the second end of the second air passage.

4. The pump of claim 1 wherein decompression of the spring during venting the air out of the pressure regulator pushes a proximal end of the piston back toward the junction, thereby covering the opening in the sidewall and blocking venting.

5. The pump of claim 1 comprising a visual indicator wherein the sidewall of the cap overlays the entire length of the second end of the second air passage when the pressure regulator is not pressurized and the cap slides distally along the exterior surface of the second end of the second air passage and exposes indicia under the sidewall of the cap indicating a pressurized state as pressure increases.

6. The pump of claim 1 wherein the cap is configured to rotate about an axis defined by the second end of the second air passage, wherein when the cap is rotated to be disposed at a first position the cap is slidable along the second end of the second air passage and an audible low pressure blow off is enabled, and when the cap is rotated to be disposed at a second position the cap is not slidable along the second end of the second air passage and the audible low pressure blow off is disabled.

7. The pump of claim 1 wherein the set point of the pressure regulator is in a range from 30 to 100 psi.

8. The pump of claim 7 wherein the set point of the pressure regulator is 40 psi.

9. The pump of claim 7 wherein the set point of the pressure regulator is 70 psi.

10. The pump of claim 1 wherein the pressure regulator comprises a plurality of different pressure set points.

11. The pump of claim 10 wherein the pressure regulator comprises a first pressure set point of 40 psi and a second pressure set point of 70 psi.

12. The pump of claim 1 further comprising a larger diameter barrel for inflating an inflatable object with a higher volume at a lower pressure and a smaller diameter barrel for inflating an inflatable object with a lower volume at a higher pressure, wherein the pump is switchable to operate using either the larger diameter barrel or the smaller diameter barrel.

13. The pump of claim 12 wherein the smaller diameter barrel is configured to be telescopically disposed inside the larger diameter barrel and is switchable to be selectively attached to a plunger shaft attached to a handle so that the smaller diameter barrel operates reciprocally in the larger diameter barrel; or selectively attached to the larger diameter barrel so that the plunger shaft operates reciprocally in the smaller diameter barrel.

14. The pump of claim 13 wherein the pump comprises a lever rotatably attached to an upper end cap of the smaller diameter barrel;

wherein when the lever is rotated to a first position wherein the lever is engaged with a portion of the circumference of the surface of the handle and an upper face of a flange on the plunger shaft proximate to the handle to lock the lever and the upper end cap of the smaller diameter barrel to the plunger shaft, whereby moving the plunger shaft up and down moves the smaller diameter barrel reciprocally within the larger diameter barrel and the pump is effective as a larger volume lower pressure device; and wherein when the lever is rotated to a second position wherein the lever is engaged with a portion of the circumference of a surface of an upper end cap of the larger diameter barrel and a lower face of a flange on the upper end cap of the larger diameter barrel to lock the lever and the upper end cap of the smaller diameter barrel to the upper end cap of the larger diameter barrel, whereby moving the plunger shaft up and down moves a plunger at the bottom of the plunger shaft reciprocally within the smaller diameter barrel and the pump is effective as a smaller volume higher pressure device.

15. The pump of claim 14 wherein venting of the air through the opening in the sidewall of the second end of the second air passage produces a sound audible to a user of the pump.

16. The pump of claim 15 comprising a vibratory element that augments the sound of the air venting through the opening in the sidewall of the second end of the second air passage.

17. The pump of claim 14 wherein decompression of the spring during venting the air out of the pressure regulator pushes thea proximal end of the piston back toward the junction, thereby covering the opening in the sidewall and blocking venting.

18. The pump of claim 14 comprising a visual indicator wherein the sidewall of the cap overlays at least a portion of the length of the second end of the second air passage when the pressure regulator is not pressurized and the cap slides distally along the exterior surface of the second end of the second air passage and exposes indicia under the sidewall of the cap indicating a pressurized state as pressure increases.

19. The pump of claim 14 wherein the cap is configured to rotate about an axis defined by the second end of the second air passage, wherein when the cap is rotated to be disposed at a first position the cap is slidable along the second end of the second air passage and an audible low pressure blow off is enabled, and when the cap is rotated to be disposed at a second position the cap is not slidable along the second end of the second air passage and the audible low pressure blow off is disabled.

20. The pump of claim 14 wherein the set point of the pressure regulator is in a range from 30 to 100 psi.

21. The pump of claim 14 wherein the larger diameter barrel has an inner diameter from 40 to 50 mm.

22. The pump of claim 14 wherein the smaller diameter barrel has an inner diameter from 25 to 35 mm.

23. A pressure regulator comprising a first air passage wherein a first end of the first air passage is configured to be in fluid communication with an outlet of a pump and a second end of the first air passage forms a junction with a second air passage having a first end and a second end wherein the junction of the first air passage with the second air passage is disposed between the first and second ends of the second air passage;

wherein the first end of the second air passage is configured to be in fluid communication with an inflatable object;

wherein the second end of the second air passage comprises a piston disposed therein, wherein the piston is slidingly engaged with an interior surface of the second end of the second air passage and a distal end of the piston passes through an opening in the distalmost end of the second end of the second air passage and is attached to an inner surface of a base of a cap having a side wall attached to at least a portion of the base and disposed overlying and slidingly engaged with at least a portion of an exterior surface of the second end of the second air passage;

a coil spring disposed around the piston and inside the second end of the second air passage;

an opening in the side wall of the second end of the second air passage in fluid communication with a vent to air external to the pressure regulator;

wherein the piston and the cap are configured to move distally away from the junction as pressure inside the second end of the second air passage increases, wherein the coil spring is in a non-compressed state when an interior of the pressure regulator is not pressurized and is in a compressed state when the interior of the pressure regulator is pressurized; when the pressure inside the second air passage is at or below a defined set point, the opening is blocked by the piston, and when pressure inside the second air passage is above the defined set point, the opening is not blocked by the piston and air from inside the second air passage is vented to the air external to the pressure regulator.

24. The pressure regulator of claim 23 wherein venting of the air through the opening in the sidewall of the second end of the second air passage produces a sound audible to a user of the pump; optionally wherein the pump further comprises a vibratory element that augments the sound of the air venting through the opening in the sidewall of the second end of the second air passage.

25. The pressure regulator of claim 23 wherein decompression of the spring during venting air out of the pressure regulator pushes a proximal end of the piston back toward the junction, thereby covering the opening in the sidewall and blocking venting.

26. The pressure regulator of claim 23 wherein the cap is configured to rotate about an axis defined by the second end of the second air passage, wherein when the cap is rotated to be disposed at a first position the cap is slidable along the second end of the second air passage and an audible low pressure blow off is enabled, and when the cap is rotated to be disposed at a second position the cap is not slidable along the second end of the second air passage and the audible low pressure blow off is disabled.

27. The pressure regulator of claim 23 comprising a visual indicator wherein the sidewall of the cap overlays at least a portion of the length of the second end of the second air passage when the pressure regulator is not pressurized and the cap slides distally along the exterior surface of the second end of the second air passage and exposes indicia under the sidewall of the cap indicating a pressurized state as pressure increases.

28. The pressure regulator of claim 23 wherein the set point is in a range from 30 to 100 psi.

29. The pressure regulator of claim 28 wherein the set point is 40 psi.

30. The pressure regulator of claim 28 wherein the set point is 70 psi.

31. The pressure regulator of claim 23 comprising a plurality of different pressure set points.

32. The pressure regulator of claim 31 wherein the pressure regulator comprises a first pressure set point of 40 psi and a second pressure set point of 70 psi.

33. A pump comprising a larger diameter barrel for inflating an inflatable object with a higher volume at a lower pressure and a smaller diameter barrel for inflating an inflatable object with a lower volume at a higher pressure, wherein the pump is switchable to operate using either the larger diameter barrel or the smaller diameter barrel; wherein the smaller diameter barrel is configured to be telescopically disposed inside the larger diameter barrel and is switchable to be selectively attached to a plunger shaft attached to a handle so that the smaller diameter barrel operates reciprocally in the larger diameter barrel; or selectively attached to the larger diameter barrel so that the plunger shaft operates reciprocally in the smaller diameter barrel;

wherein the pump comprises a lever rotatably attached to an upper end cap of the smaller diameter barrel;

wherein when the lever is rotated to a first position wherein the lever is engaged with a portion of the circumference of a surface of the handle and an upper face of a flange on the plunger shaft proximate to the handle to lock the lever and the upper end cap of the smaller diameter barrel to the plunger shaft; and when the lever is rotated to a second position wherein the lever is engaged with a portion of the circumference of a surface of an upper end cap of the larger diameter barrel and a lower face of a flange on the upper end cap of the larger diameter barrel to lock the lever and the upper end cap of the smaller diameter barrel to the upper end cap of the larger diameter barrel.

34. The pump of claim 33 wherein when the lever is rotated to the first position, moving the plunger shaft up and down moves the smaller diameter barrel reciprocally within the larger diameter barrel and the pump is effective as a larger volume lower pressure device; and when the lever is rotated to the second position, moving the plunger shaft up and down moves a plunger at the bottom of the plunger shaft reciprocally within the smaller diameter barrel and the pump is effective as a smaller volume higher pressure device.

35. The pump of claim 33 wherein the larger diameter barrel has an inner diameter from 40 to 50 mm.

36. The pump of claim 33 wherein the smaller diameter barrel has an inner diameter from 25 to 35 mm.

* * * * *